US007405547B2

(12) United States Patent
Kanzaki

(10) Patent No.: US 7,405,547 B2
(45) Date of Patent: Jul. 29, 2008

(54) STABILIZED DC POWER SUPPLY CIRCUIT HAVING A CURRENT LIMITING CIRCUIT AND A CORRECTION CIRCUIT

(75) Inventor: Takao Kanzaki, Kashihara (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 150 days.

(21) Appl. No.: 11/414,228

(22) Filed: May 1, 2006

(65) Prior Publication Data

US 2006/0255785 A1 Nov. 16, 2006

(30) Foreign Application Priority Data

May 16, 2005 (JP) ..... 2005-142136
Jan. 10, 2006 (JP) ..... 2006-002119

(51) Int. Cl.
*G05F 1/573* (2006.01)

(52) U.S. Cl. ..... 323/277; 323/279; 323/907

(58) Field of Classification Search ..... 323/277, 323/279, 907
See application file for complete search history.

(56) References Cited

U.S. PATENT DOCUMENTS 3,796,943 A * 3/1974 Nelson et al. ..... 323/277
4,800,331 A * 1/1989 Vesce et al. ..... 323/277
5,004,970 A * 4/1991 Barou ..... 323/277
5,550,462 A * 8/1996 Nakajima ..... 323/277
5,804,956 A * 9/1998 Pulvirenti ..... 323/277
5,986,441 A * 11/1999 Koroncai et al. ..... 323/277
6,034,515 A * 3/2000 Hirmer ..... 323/277
6,870,351 B2 * 3/2005 Sugimura ..... 323/277
7,215,103 B1 * 5/2007 Wong et al. ..... 323/277

FOREIGN PATENT DOCUMENTS

JP 3-136112 A 6/1991
JP 2000-270469 A 9/2000

* cited by examiner

*Primary Examiner*—Jeffrey L Sterrett
(74) *Attorney, Agent, or Firm*—Birch, Stewart, Kolasch & Birch, LLP

(57) ABSTRACT

A stabilized DC power supply circuit of the present invention includes an output current limiting circuit for limiting an output current of an output transistor, and a correction circuit for correcting variation of restriction in the output current caused by variation in a current amplification factor of the output transistor. The correction circuit includes a correcting transistor that is manufactured in the same manufacturing process as the output transistor and formed so as to have the same tendency of manufacturing process variation in current amplification factor etc. as that of the output transistor.

42 Claims, 19 Drawing Sheets

STABILIZED DC POWER SUPPLY CIRCUIT HAVING A CURRENT LIMITING CIRCUIT AND A CORRECTION CIRCUIT

This nonprovisional application claims priority under 35 U.S.C. §119(a) on Patent Application No. 2005-142136 filed in Japan on May 16, 2005 and Patent Application No. 2006-002119 filed in Japan on Jan. 10, 2006, the entire contents of which are hereby incorporated by reference.

BACKGROUND OF THE INVENTION

1. Field of the Invention

The present invention relates to a stabilized DC (Direct Current) power supply circuit (stabilized DC power supply unit) and, more specifically, a stabilized DC power supply circuit having the function of limiting an output current.

2. Description of Related Art

FIG. 5 shows a circuit diagram (equivalent circuit diagram) of a conventional example of a stabilized DC power supply circuit. A stabilized DC power supply circuit 101 (hereinafter, referred to as "power supply circuit 101" simply) of FIG. 5 includes an output transistor Q1, a driving transistor Q3, voltage division resistors R1 and R2 for dividing an output voltage Vo, an error amplifier 7, a reference voltage source 8, and an output current limiting circuit 102.

FIG. 6 shows a circuit diagram of the power supply circuit 101 that has embodied an internal circuit of the output current limiting circuit 102. The output current limiting circuit 102 shown in FIG. 6 includes a differential amplifier 4, a constant current source 5, and resistors R103 and R104. In FIG. 6, the differential amplifier 4 compares a potential $V_A$ represented by a product of a base current $I_{B1}$ of the output transistor Q1 and a resistance value of the resister R103 with a potential $V_B$ represented by a product of a constant current I1 output from the constant current source 5 and a resistance value of the resistor R104.

If the base current $I_{B1}$ of the output transistor Q1 increases with an increasing output current Io of the power supply circuit 101 until $V_A$ exceeds $V_B$, the differential amplifier 4 starts to draw out a current from the error amplifier 7, thereby finally reducing to zero a current to be supplied from the error amplifier 7 to a base of the driving transistor Q3. In such a manner, the output current limiting circuit 102 (differential amplifier 4) limits the base current $I_{B1}$ of the output transistor Q1, thereby restricting the output current Io.

FIG. 7 shows a circuit diagram of a power supply 201 that employs an output current limiting circuit 102*a* different from the output current limiting circuit 102. In FIG. 7, the same components as those of FIGS. 5 and 6 are indicated by the same reference numerals. The base current $I_{B1}$ of the output transistor Q1 flows through a transistor Q4 whose collector and base are short-circuited and the resistor R103 to a ground. The output current limiting circuit 102*a* in the power supply circuit 201 includes a transistor Q5 and the resistors R103 and R104.

In the power supply circuit 201, the transistors Q4 and Q5 form a current mirror circuit, so that a collector current of the transistor Q5 increases in proportion to a collector current of the transistor Q4. That is, if the base current $I_{B1}$ of the output transistor Q1 increases with the increasing output current Io, the transistor Q5 starts to draw out a current from the error amplifier 7, thereby finally eliminating a current to be supplied from the error amplifier 7 to a base of the driving transistor Q3. In such a manner, the output current limiting circuit 102*a* in the power supply circuit 201 functions to limit the base current $I_{B1}$ of the output transistor Q1, thereby restricting the output current Io.

The following will consider the power supply circuit 101 of FIG. 6. A threshold value of such a magnitude of the output current Io that a relationship of $V_A=V_B$ may be established, that is, a threshold current value at which the output current limiting circuit 102 starts to limit an increase in output current Io is referred to as an output peak current (limit current; limit value) $I_{OP}$.

A magnitude of the base current $I_{B1}$ of the output transistor Q1 in a condition where the output current Io is limited largely depends on a current amplification factor $h_{FE1}$ of the output transistor Q1. The current amplification factor $h_{FE1}$ of the output transistor Q1, in turn, varies with variation of the manufacturing process and, also, varies with the early effect that corresponds to variation in input voltage Vi and changes in ambient temperature. Further, resistance values of the resistors R103 and R104 also vary with variation of the manufacturing process as well as changes in ambient temperature.

Since the output peak current $I_{OP}$ represents a magnitude of the output current Io at which the relationship of $V_A=V_B$ is established, it is influenced by variation in current amplification factor $h_{FE1}$ and resistance values of the resistors R103 and R104. That is, the value of the output peak current $I_{OP}$ also varies largely with variation of the manufacturing process and changes in input voltage Vi and ambient temperature.

For example, if the current amplification factor $h_{FE1}$ decreases due to variation of the manufacturing process etc., the output peak current $I_{OP}$ decreases. Further, if the resistance value of the resistor R104 decreases to a level smaller than a design value (target value) or the resistance value of the resistor R103 increases in excess of the design value (target value) owing to variation of the manufacturing process, the relationship of $V_A=V_B$ is established at a smaller value of the base current $I_{B1}$, so that the output peak current $I_{OP}$ decreases.

In a case where a rated current of an output of the power supply circuit 101 (or a rated current of a power supply IC mounted with the power supply circuit 101) is 300 mA, desirably, the output peak current $I_{OP}$ (specification value of the output peak current $I_{OP}$) is about 330 to 400 mA ordinarily. However, in the conventional example, the output peak current $I_{OP}$ largely depends on variation in current amplification factor $h_{FE1}$ and the resistance values of the resistors R103 and R104 as described above, so that its specification value becomes about 330 to 600 mA or larger.

It is to be noted that the power supply circuit shown in FIGS. 6 or 7 or this circuit excluding the output transistor Q1 is often used as a stabilized DC power supply integrated circuit (IC) in an electronic apparatus for recording information to and reproducing it from a recording medium represented by a compact disk read only memory (CD-ROM), a digital versatile disk read only memory (DVD-ROM), a digital versatile disk random access memory (DVD-RAM), etc. These electronic apparatuses are greatly desired to be more compact and thinner and more inexpensive.

Generally, when a voltage is applied to a stabilized DC power supply IC, a maximum current (maximum capacity current) that this stabilized DC power supply IC can supply, that is, the output peak current $I_{OP}$ flows instantaneously. Therefore, it is necessary to set a current capacity of a device provided at a preceding stage of the stabilized DC power supply IC to such a value that this output peak current $I_{OP}$ can be supplied.

For example, in a case where a conventional stabilized DC power supply IC is employed and its rated output current is 300 mA as described above, a specification value of the output peak current $I_{OP}$ becomes, for example, 600 mA or larger, so that it is necessary to set the current capacity of the preceding-stage device to at least 600 mA. Such an increase in current capacity increases a size and costs of the electronic apparatus as a whole.

Taking into these problems, Japanese Patent Application Laid-Open No. 2000-270469 (hereinafter, referred to as Patent Literature 1) has proposed a circuit that reduces variation in output peak current of the output transistor caused by the early effect.

Further, Japanese Patent Application Laid-Open No. H03-136112 (1991) (hereinafter, referred to as Patent Literature 2) has proposed a circuit for reducing variation in output peak current by inserting a current detecting resistor between an input terminal and an output transistor to limit an output current based on a voltage generated across this current detecting resistor.

As described above, an increase in variation of the output peak current $I_{OP}$ leads to an increase in current capacity of the device provided at the preceding stage. This current capacity of the preceding-stage device needs to be reduced as much as possible in order to decrease the costs and the size of the electronic apparatus as a whole. That is, it is important to reduce variation in output peak current $I_{OP}$.

The circuit disclosed in Patent Literature 1 does not take into account variation in current amplification factor of the output transistor that are caused by variation of the manufacturing process and temperature and, therefore, has an insufficient effect to suppress variation in output peak current.

In the circuit disclosed in Patent Literature 2, on the other hand, variation in resistance value of the current detecting resistor or changes in temperature of this resistance value have an influence on the output peak current, so that this disclosed circuit does not in all cases have a sufficient effect to suppress variation in output peak current. Further, a resistance value of the current detecting resistor needs to be low sufficiently, so that this current detecting resistor occupies a greatly large area. Therefore, a technology of Patent Literature 2 cannot be optimal for the stabilized DC power supply IC.

Although the problems have been described which arise in use of a bipolar transistor, the same problems occur also when a field effect transistor is used.

SUMMARY OF THE INVENTION

In view of the above, the present invention has been developed, and it is an object of the present invention to provide a stabilized DC power supply circuit that can reduce variation in restriction of an output current owing to variation of a manufacturing process etc.

To achieve this object, according to the present invention, a stabilized DC power supply circuit equipped with an output transistor between an input terminal and an output terminal includes an output current limiting circuit for limiting an output current of the output transistor, and a correction circuit for correcting variation in restriction of the output current caused by variation in relationship between a physical quantity at a control electrode of the output transistor and the output current of the output transistor.

For example, the correction circuit includes a correcting transistor that is manufactured through the same manufacturing process as that for the output transistor and formed so as to have the same tendency of variation of the manufacturing process of the relationship as that of the output transistor and uses the correcting transistor to thereby correct variation in restriction of the output current of the output transistor caused by variation of the relationship.

By using the correcting transistor, it is possible to offset the manufacturing process variation of the relationship (current amplification factor etc.) at the output transistor, thereby correcting (suppressing) variation of the above-described limitations by the output current limiting circuit.

Further, for example, the correcting transistor has also the same temperature-dependency of the relationship as that of the output transistor.

It is thus possible to correct variation of the above-described limitations caused by temperature variation of the relationship (current amplification factor etc.) in the output transistor.

Further, for example, the output transistor is a bipolar transistor, the relationship between the physical quantity at the control electrode and the output current is current amplification factor, and the correction circuit includes a correcting transistor that is manufactured through the same manufacturing process as that for the output transistor and formed so that the current amplification factor of its own may also increase as the current amplification factor of the output transistor increases due to variation of the manufacturing process and uses the correcting transistor to thereby correct variation in restriction of the output current of the output transistor caused by variation in the current amplification factor of the output transistor.

Further, for example, the output transistor is a field effect transistor, the relationship between the physical quantity at the control electrode and the output current is mutual conductance, and the correction circuit includes a correcting transistor that is manufactured through the same manufacturing process as that for the output transistor and formed so that the mutual conductance of its own may also increase as the mutual conductance of the output transistor increases due to variation of the manufacturing process and uses the correcting transistor to thereby correct variation in restriction of the output current of the output transistor caused by variation in the mutual conductance of the output transistor.

Further, for example, the output transistor is a bipolar transistor, the relationship between the physical quantity at the control electrode and the output current is current amplification factor, and the output current limiting circuit limits the output current of the output transistor based on a detecting current which is a base current of the output transistor.

Further, for example, the output transistor is a field effect transistor, the relationship between the physical quantity at the control electrode and the output current is mutual conductance, and the output current limiting circuit limits the output current of the output transistor based on a detecting current that reflects the output current of the output transistor and the mutual conductance of the output transistor.

Specifically, for example, the output current limiting circuit includes a differential amplifier that receives at its first input terminal a detection potential that corresponds to the detecting current and compares the detection potential with a reference potential supplied at its second input terminal and uses an output of the differential amplifier to thereby limit the output current of the output transistor.

For example, if the detection potential is larger than the reference potential, the differential amplifier limits the detecting current to thereby limit the output current of the output transistor.

Further, for example, the output current limiting circuit includes a detecting current mirror circuit for proportionally multiplying the detecting current and outputting it and uses an output current of the detecting current mirror circuit, to thereby limit the output current of the output transistor.

It is thus possible to reduce the number of elements of the power supply circuit.

Further, for example, the detection potential is determined by a current flowing through a first resistor connected to the first input terminal, and the reference potential is determined by a current flowing through a second resistor connected to the second input terminal.

Further, for example, preferably the first and second resistors are resistors of the same type that have been manufactured through the same manufacturing process.

Accordingly, the first and second resistors are similarly exposed to variation of the manufacturing process and an influence of an ambient temperature, so that it is hopefully possible to suppress variation of the above-described limitations caused by a difference in variation between the first and second resistors.

Further, for example, the first and second resistors may be a variable resistor.

It is thus possible to bring a resistance value of the first and second resistors closer to a design value. That is, it is possible to greatly reduce variation in resistance value caused by variation etc. of a manufacturing process and, as a result, further suppress variation of the above-described limitations.

Further, for example, the output transistor and the correcting transistor are each a bipolar transistor, the relationship between the physical quantity at the control electrode and the output current is current amplification factor, and the output current limiting circuit limits the output current of the output transistor based on a detecting current which is a base current of the output transistor and a correcting current obtained from the correcting transistor.

Since current amplification factors of the output transistor and the correcting transistor are similarly influenced by the variation factors, by limiting the output current of the output transistor based not only on the detecting current but also on the correcting current, it is possible to, for example, offset the influence of the variation factors, thus suppressing variation of the above-described limitations.

Specifically, for example, the correction circuit supplies a constant current to a base of the correcting transistor, to output an output current of the correcting transistor as the correcting current (of which configuration example is hereinafter referred to as "first configuration example").

Thus, if the current amplification factor of the output transistor has varied in such a direction as to become relatively large, for example, the detecting current, which is a base current of the output transistor, becomes relatively small. On the other hand, in this case, the current amplification factor of the correcting transistor also varies in the direction to become relatively large, so that the correcting current, which is an output current (emitter current or collector current) of the correcting transistor becomes relatively large. Therefore, for example, by utilizing a total sum of the detecting current and the correcting current, the variation is offset, thereby suppressing variation of the above-described limitations. It is to be noted that a circuit that corresponds to this first configuration example is exemplified by, for example, a circuit of FIG. 1 later.

Further, specifically, for example, the correction circuit supplies a constant current as an output current of the correcting transistor, to output a base current of the correcting transistor as the correcting current (of which configuration example is hereinafter referred to as "second configuration example").

Thus, if the current amplification factor of the output transistor has varied in such a direction as to become relatively large, for example, the detecting current and the correcting current both become relatively small. By utilizing this coupling of variation of these current amplification factors, the variation of the limitations can be suppressed. It is to be noted that a circuit that corresponds to this second configuration example is exemplified by, for example, a circuit of FIG. 2 later.

Further, specifically, for example, the correction circuit includes a correcting current mirror circuit for proportionally multiplying the detecting current and providing it as the base current of the correcting transistor, to thereby output an output current of the correcting transistor as the correcting current (of which configuration example is hereinafter referred to as "third configuration example").

Further, specifically, for example, the correction circuit includes a correcting current mirror circuit for proportionally multiplying the detecting current and providing it as an output current of the correcting transistor, to thereby output the base current of the correcting transistor as the correcting current (of which configuration example is hereinafter referred to as "fourth configuration example").

According to the third and fourth configurations, it is possible to reduce the number of elements of the power supply circuit. It is to be noted that circuits that correspond to the third and fourth configuration examples are exemplified by, for example, circuits of FIGS. 9 and 10, respectively later.

Further, for example, the output transistor and the correcting transistor are each a field effect transistor, the relationship between the physical quantity at the control electrode and the output current is mutual conductance, and the output current limiting circuit limits the output current of the output transistor based on a detecting current that reflects the output current of the output transistor and the mutual conductance of the output transistor and based on the correcting current obtained from the correcting transistor.

Since mutual conductance of the output transistor and that of the correcting transistor are similarly influenced by the variation factors, by limiting the output current of the output transistor based not only on the detecting current but also on the correcting current, it is possible to, for example, offset the influence of the variation factors, thus suppressing variation of the above-described limitations.

Specifically, for example, the correction circuit supplies a constant voltage as a gate voltage of the correcting transistor, to output an output current of the correcting transistor as the correcting current (of which configuration example is hereinafter referred to as "fifth configuration example").

Further, specifically, for example, the correction circuit supplies a constant current as an output current of the correcting transistor, to output a current that flows corresponding to a gate voltage of the correcting transistor, as the correcting current (of which configuration example is hereinafter referred to as "sixth configuration example").

Further, specifically, for example, the correction circuit includes a correcting current mirror circuit for proportionally multiplying the detecting current and outputting it, to apply a voltage that corresponds to an output current of the correcting current mirror circuit to a gate of the correcting transistor, thereby outputting an output current of the correcting transistor as the correcting current (of which configuration example is hereinafter referred to as "seventh configuration example").

It is to be noted that a circuit that corresponds to the fifth configuration example is exemplified by, for example, circuits of FIGS. 17 and 20. It is to be noted that circuits that correspond to the sixth and seventh configuration examples are exemplified by, for example, circuits of FIGS. 18 and 21 respectively later.

Further, specifically, for example, in the first or fifth configuration example, the output current limiting circuit includes a differential amplifier that receives at its first input terminal a detection potential that corresponds to the detecting current and compares the detection potential with a reference potential supplied at its second input terminal, if the detection potential is larger than the reference potential, the differential amplifier limits the detecting current to thereby limit the output current of the output transistor, and the correcting current flows so as to raise the detection potential.

Further, specifically, for example, in the second or sixth configuration example, the output current limiting circuit includes a differential amplifier that receives at its first input terminal a detection potential that corresponds to the detecting current and compares the detection potential with a reference potential supplied at its second input terminal, if the detection potential is larger than the reference potential, the differential amplifier limits the detecting current to thereby limit the output current of the output transistor, and the correcting current flows so as to raise the reference potential.

Further, specifically, for example, in the third, fourth, fifth, or seventh configuration example, the output current limiting circuit includes a detecting current mirror circuit for proportionally multiplying the detecting current and outputting it and uses an output current of the detecting current mirror circuit, to thereby limit the output current of the output transistor, and not only detecting current but also the correcting current flow through a first resistor that is provided on an input side of the detecting current mirror circuit and that forms the detecting current mirror circuit.

Further, for example, the output transistor is a field effect transistor, the relationship between the physical quantity at the control electrode and the output current is mutual conductance, and the output current limiting circuit limits the output current of the output transistor based on a reflection potential that reflects the output current of the output transistor and the mutual conductance of the output transistor.

Further, for example, the output transistor is a field effect transistor, the relationship between the physical quantity at the control electrode and the output current is mutual conductance, and the output current limiting circuit limits the output current of the output transistor based on a reflection potential that reflects the output current of the output transistor and the mutual conductance of the output transistor and based on a physical quantity that reflects the mutual conductance of the correcting transistor.

By utilizing the reflection potential, variation of the above-described limitations can be suppressed. It is to be noted that a circuit that utilizes the reflection potential is exemplified by, for example, circuits of FIGS. 26 and 27 later.

Further, for example, the correcting transistor is constituted of a plurality of correcting transistors.

It is thus possible to further suppress variation of the above-described limitations.

Further, for example, the correcting transistor is constituted of a plurality of correcting transistors, the correcting current mirror circuit is constituted of a plurality of transistors, and each of the correcting transistors is allocated each of the transistors that constitute the correcting current mirror circuit.

It is also possible to further suppress variation of the above-described limitations. Further, it is hopefully possible to improve a relationship between an output current and an output voltage of the power supply circuit in a condition where the output current is limited.

Further, for example, one of two conducting electrodes of the output transistor and one of two conducting electrodes of the correcting transistor are commonly connected to the input terminal that is supplied with an input voltage from an outside.

Accordingly, if the input voltage has varied, a voltage between the conducting electrodes of the output transistor and that of the correcting transistor (emitter-collector voltage or source-drain voltage) varies by (approximately) the same quantity, so that the current amplification factor or the mutual conductance of the output transistor and that of the correcting transistor are similarly influenced by the early effect. Therefore, variation in current amplification factor or mutual conductance of the correcting transistor caused by variation in input voltage can be used to, for example, offset those of the output transistor, thereby suppressing variation of the above-described limitations with respect to the variation of the input voltage.

Further, for example, any one of the above-described stabilized DC power supply circuits may be used to configure an electronic apparatus.

As described above, according to a stabilized DC power supply circuit according to the present invention, it is possible to reduce variation in limitations of an output current caused by variation etc. of a manufacturing process. Accordingly, by using a stabilized DC power supply circuit according to the present invention to configure an electronic apparatus, it is possible to reduce costs and a size of the electronic apparatus as a whole.

DETAILED DESCRIPTION OF PREFERRED EMBODIMENTS

First Embodiment

Figure 1:
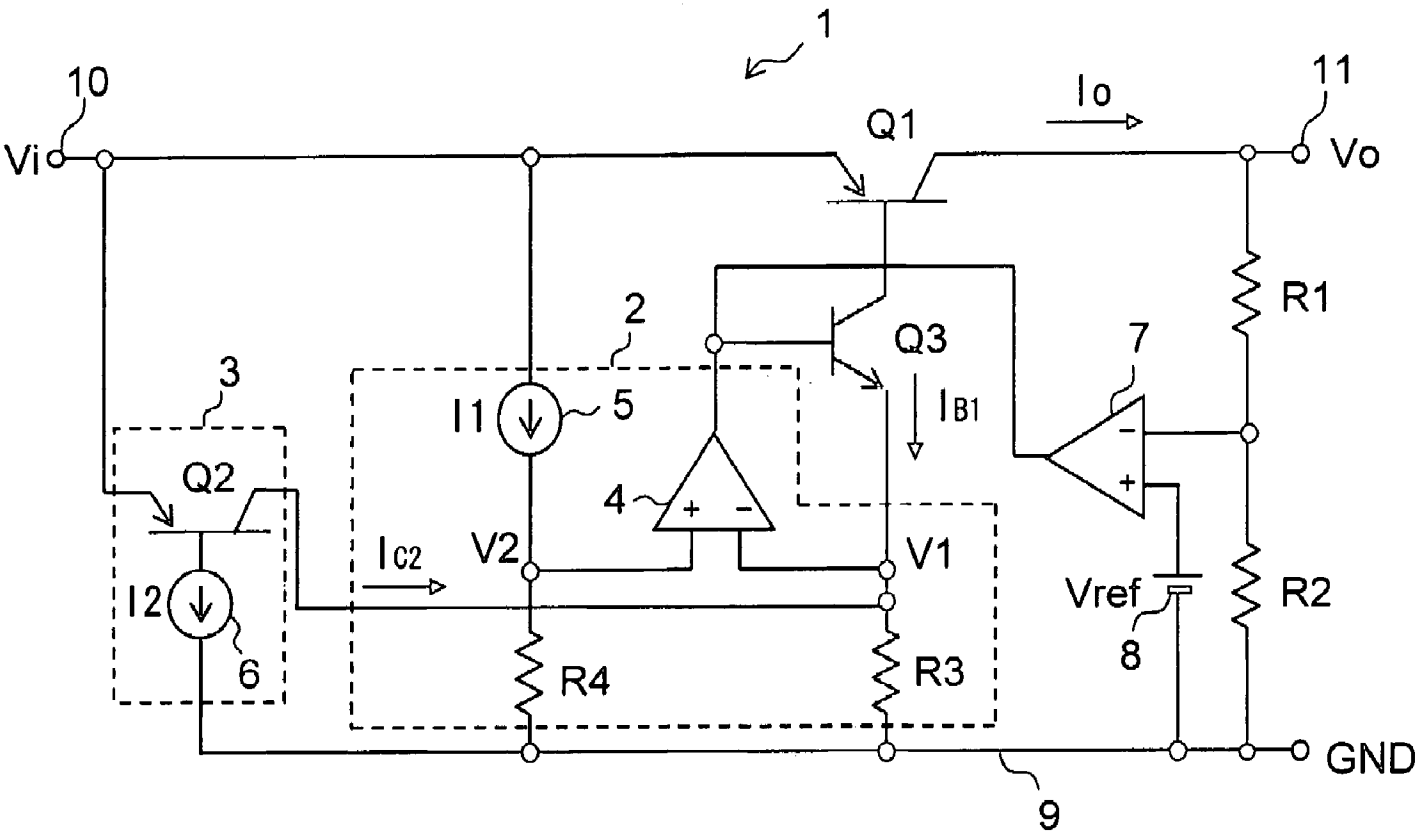
FIG. 1 is a circuit diagram of a stabilized DC power supply circuit according to a first embodiment of the present invention.

The following will describe a first embodiment of a stabilized DC (Direct Current) power supply circuit (stabilized DC power supply unit) according to the present invention. FIG. 1 is a circuit diagram of a stabilized DC power supply circuit 1 (hereinafter, referred to as "power supply circuit 1" simply) according to the first embodiment.

The power supply circuit 1 includes an output transistor Q1 made of a PNP type bipolar transistor, a driving transistor Q3 made of an NPN type bipolar transistor, an output current limiting circuit 2 for limiting a magnitude of an output current Io of the power supply circuit 1, a correction circuit 3 for correcting (suppressing) variation in magnitude of the output current Io limited by the output current limiting circuit 2, voltage division resistors R1 and R2, an error amplifier 7, and a reference voltage source 8.

The output current limiting circuit 2 includes a differential amplifier 4, resistors R3 and R4, and a constant current source 5. The correction circuit 3 includes a correcting transistor Q2 made of a PNP type bipolar transistor and a constant current source 6.

An input terminal 10 is supplied with an input voltage Vi (e.g., 12 VDC), which is a voltage-to-be-stabilized from an outside. The input terminal 10 is commonly connected to an emitter of the correcting transistor Q2, an emitter of the output transistor Q1, and an input side of the constant current source 5.

A collector of the output transistor Q1 is connected to an output terminal 11 to which an output voltage Vo of the power supply circuit 1 is to be output and also to a ground line 9 held to 0-V potential (GND) via a series circuit including the voltage dividing resistors R1 and R2. In the error amplifier 7, its inverting input terminal (−) is supplied with a potential of a node between the voltage dividing resistors R1 and R2 and its non-inverting input terminal (+) is supplied with a reference potential Vref output by the reference voltage source 8.

An output side of the constant current source 5 is connected via the resistor R4 to the ground line 9 and also to a non-inverting input terminal (+) of the differential amplifier 4. A constant current (whose magnitude is indicated by I1) output by the constant current source 5 flows through the resistor R4 into the ground line 9. An inverting input terminal (−) of the differential amplifier 4, on the other hand, is connected to a node between an emitter of the driving transistor Q3 and the resistor R3 and also to a collector of the correcting transistor Q2.

An input side of the constant current source 6 is connected to a base of the correcting transistor Q2 and its output side is connected to the ground line 9. A constant current (whose magnitude is indicated by I2) output by the constant current source 6 flows into the ground line 9 as a base current of the correcting transistor Q2. Although the power supply circuit 1 is made by, for example, epitaxial growth of a variety of layers on a semiconductor substrate, impurity diffusion, etc., the base current of the correcting transistor Q2 is constant and, therefore, the magnitude of this base current is not influenced by variation of the semiconductor manufacturing process or changes in ambient temperature. A current flowing through the resistor R4 is also constant and, therefore, its magnitude is not influenced either.

A collector of the driving transistor Q3 is connected to a base of the output transistor Q1 and, also, an emitter thereof is connected to the ground line 9 via the resistor R3. To a base of this driving transistor Q3 are connected an output of the error amplifier 7 and that of the differential amplifier 4. It is to be noted that potentials of the inverting input terminal (−) and the non-inverting input terminal (+) of the differential amplifier 4 are referred to as a detection potential V1 (indicated by "V1" in some cases) and a reference potential V2 (indicated by "V2" in some cases), respectively.

The output transistor Q1 and the correcting transistor Q2 are made by forming a p-type semiconductor on both sides of an n-type semiconductor in the same manufacturing processes. Electrical characteristics (current amplification factor etc.) of the output transistor Q1 and the correcting transistor Q2 vary with whether they are manufactured by a process for forming only bipolar transistors, a process for forming bipolar complementary metal oxide semiconductors (BICMOSs), a process for forming high-breakdown voltage transistors, etc. (that is, those characteristics vary with impurity diffusion densities, semiconductor substrate temperature at the time of manufacture, differences in manufacturing steps, etc.). Conditions for these manufacturing processes are made the same (that is, the same manufacturing processes are employed) in forming of the output transistor Q1 and the correcting transistor Q2. Therefore, there is a very little difference (no difference ideally) in electrical characteristics (current amplification factor etc.) between the output transistor Q1 and the correcting transistor Q2 caused by a difference in manufacturing process. However, the current amplification factor varies each time they are manufactured even if they are formed in the same manufacturing processes (variation in manufacturing).

Accordingly, the output transistor Q1 and the correcting transistor Q2 are formed so that they may have the same tendency of variation (variation in manufacturing) in current amplification factor during the manufacturing processes. That is, the output transistor Q1 and the correcting transistor Q2 are formed so that their respective current amplification factors $h_{FE1}$ and $h_{FE2}$ may vary in the same direction by the same degree through variation of the manufacturing processes.

Further, the output transistor Q1 and the correcting transistor Q2 are formed so that temperature-dependencies of their respective current amplification factors (characteristics of changes in current amplification factor with respect to change in temperature during operation) may have the same tendency. That is, the output transistor Q1 and the correcting transistor Q2 are formed so that their respective current amplification factors $h_{FE1}$ and $h_{FE2}$ may change in the same direction by the same degree with respect to the same change in temperature (change in temperature during operations of the power supply circuit). It is to be noted that the temperature herein means an ambient temperature of the output transistor Q1 and the correcting transistor Q2 and can be thought of as an ambient temperature of the power supply circuit 1.

The above-described phenomenon that "manufacturing process variation-dependency and temperature-dependency of current amplification factors $h_{FE1}$ and $h_{FE2}$ have the same tendency" is hereinafter referred to as "characteristics similarity α" for convenience in explanation. That is, for example, such expression is used that the output transistor Q1 and the correcting transistor Q2 are formed so as to have the characteristics similarity α or that the correcting transistor Q2 has the characteristics similarity α in relation to the output transistor Q1.

For the output transistor Q1 and the correcting transistor Q2 to have the characteristics similarity α, desirably, they have the same shape. The shape herein means a semiconductor shape in which a bipolar transistor is formed, for example. That is, in comparison between the output transistor Q1 and the correcting transistor Q2, desirably, shapes of semiconductor regions in which the emitter, the collector, and the base are formed are the same, respectively, and these semiconductor regions have the same positional relationship (same cross-sectional structure).

Further, in comparison between the output transistor Q1 and the correcting transistor Q2, not only the semiconductor shapes in which the bipolar transistors are formed but also shapes of electrodes connected to the semiconductor regions may be the same. That is, the shapes of the output transistor Q1 and the correcting transistor Q2 may be the same, including a positional relationship and a magnitude relationship between an emitter forming semiconductor region and an emitter electrode connected thereto, those between a collector forming semiconductor region and a collector electrode connected thereto, and those between a base forming semiconductor region and a base electrode connected thereto.

For the output transistor Q1 and the correcting transistor Q2 to have the characteristics similarity α, desirably, they have the same sizes (magnitudes) of the above-described shapes. However, since the correcting transistor Q2 may only need to have a relatively small output current capacity, it may be possible to form the correcting transistor Q2 smaller than the output transistor Q1 depending on a required output current capacity while keeping the sameness in shape between them.

Although desirably the output transistor Q1 and the correcting transistor Q2 have the same shape and the same size as described above, these shape and size each need not be all the same as far as these transistors have the characteristics similarity α. For example, if the output transistor Q1 and the correcting transistor Q2 have been formed as a vertical PNP transistor, the current amplification factor does not depend on a width of a collector-diffusion region (width in a direction of a substrate surface), so that they may have different collector-diffusion region widths.

Figure 16:
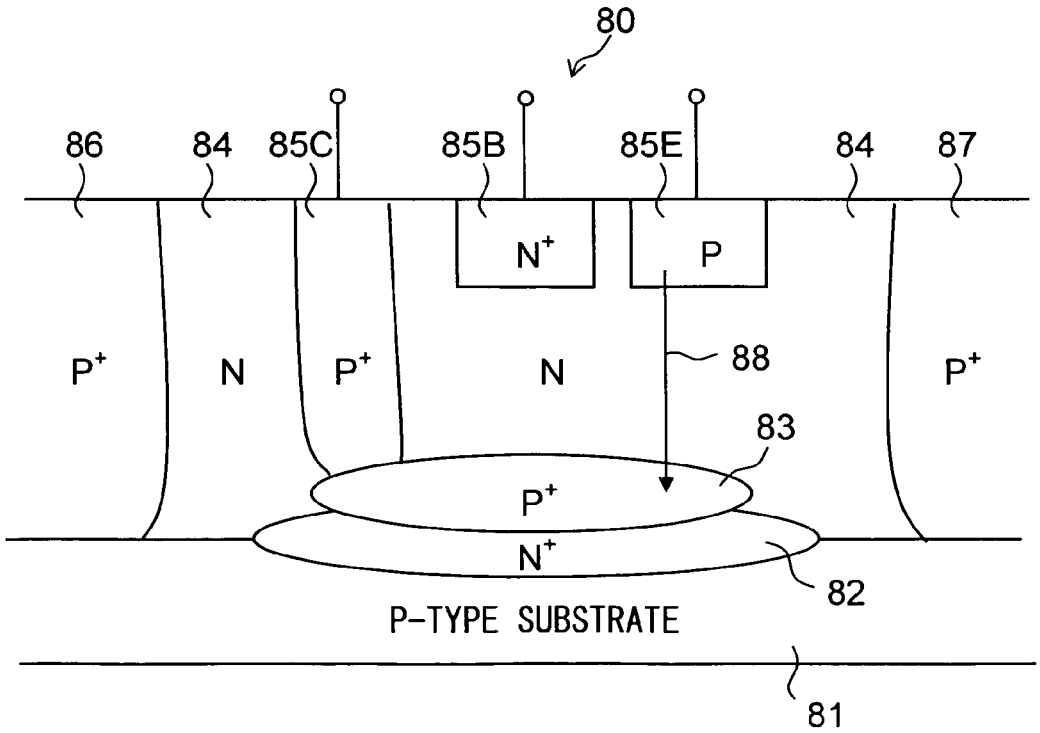
FIG. 16 is a cross-sectional view of a structure of a transistor that can be employed as an output transistor and a correcting transistor of FIG. 1 etc.

FIG. 16 shows a cross-sectional structure example of a vertical PNP transistor 80. The PNP transistor 80 can be employed as the output transistor Q1 and the correcting transistor Q2.

A buried diffusion layer 82 in which an N-type impurity is diffused at a relatively high concentration is formed on a P-type substrate 81, on which further a low-resistance P-type buried diffusion layer 83, which provides a flow path for a collector current of the PNP transistor 80, is formed through a diffusion process. By diffusing impurities into an N-type epitaxial-growth layer formed on the substrate 81 through epitaxial growth, a P-type collector-diffusion region 85C, an N-type base-diffusion region 85B, and a P-type emitter-diffusion region 85E (hereinafter, abbreviated as diffusion regions 85C, 85B, and 85E, respectively in some cases) are formed in this N-type epitaxial-growth layer.

These diffusion regions 85C, 85B, and 85E are separated from each other in a direction of a surface of the substrate 81 in such a manner that an N-type well 84 is present between these diffusion regions 85C, 85B, and 85E in the surface direction of the substrate 81. In a direction of a thickness of the substrate 81, the well 84 is present between the diffusion regions 85B and the buried diffusion layer 83 and between the diffusion region 85E and the buried diffusion layer 83, so that a base region of the PNP transistor 80 is formed between the base diffusion region 85B and the well 84B that are formed side by side. The collector-diffusion region 85C is formed deeper than the diffusion region 85E etc., to come in contact with the buried diffusion layer 83 directly. It is to be noted that in a horizontal direction of the substrate 81, outside the output transistor 80, P-type element separation regions 86 and 87 are formed.

In the PNP transistor 80 formed as described above, as shown by an arrow 88, a current flows from the emitter-diffusion region 85E via the well 84 to the buried diffusion layer 83, which is part of the collector region. That is, since the current flows through the base in a direction perpendicular to the surface of the substrate 81, the PNP transistor 80 is a vertical PNP transistor. A current amplification factor of such a vertical PNP transistor 80 does not depend on a width of the collector-diffusion region 85C in the surface direction of the substrate 81.

In the power supply circuit 1 of FIG. 1 thus configured, the error amplifier 7 controls a base current of the driving transistor Q3 so that a potential of the node between the voltage dividing resistors R1 and R2 may be equal to the reference potential Vref, thereby controlling a base current (base potential) of the output transistor Q1. In such a manner, the output voltage Vo is stabilized to a predetermined voltage value.

Through the resistor R3, a base current of the output transistor Q1 and a collector current of the correcting transistor Q2 flow. Therefore, by representing the base current of the output transistor Q1 by $I_{B1}$, the collector current of the correcting transistor Q2 by $I_{C2}$, and further a resistance value of the resistor R3 by R3, the detection potential V1 is given by the following Equation (1) (where a base current of the driving transistor Q3 is neglected).

$$V1=(I_{B1}+I_{C2})\times R3 \quad (1)$$

Further, by using the current amplification factors $h_{FE1}$ and $h_{FE2}$ of the respective output transistor Q1 and correcting transistor Q2, Equation (1) is changed into the following Equation (2).

$$V1=(Io/h_{FE1}+h_{FE2}\cdot I2)\times R3 \quad (2)$$

By representing a resistance value of the resistor R4 by R4, on the other hand, the reference potential V2 is given by the following Equation (3).

$$V2=I1\times R4 \quad (3)$$

If the output current Io is equal to or less than a rated current that the power supply circuit 1 can output steadily, the detection potential V1 is smaller than the reference potential V2. If the output current Io larger than this rated current flows temporarily upon, for example, application of the input voltage Vi to thereby make the detection potential V1 larger than the reference potential V2, the differential amplifier 4 starts to draw out a current from the error amplifier 7 until no current is finally supplied from the error amplifier 7 to the base of the driving transistor Q3. In such a manner, the output current limiting circuit 2 (differential amplifier 4) works to limit the base current $I_{B1}$ of the output transistor Q1, thereby restricting the collector current of the output transistor Q1, that is, the output current Io.

It is to be noted that such a magnitude of the output current Io that a relationship of V1=V2 may be established, that is, a threshold current value at which the output current limiting circuit 2 starts to limit an increase in output current Io is referred to as an output peak current (limit current; limit value) $I_{OP}$.

Since the output transistor Q1 and the correcting transistor Q2 have the characteristics similarity α as described above, the current amplification factors $h_{FE1}$ and $h_{FE2}$ are similarly influenced by variation of the semiconductor manufacturing processes and variation in ambient temperature. Furthermore, the emitters of the output transistor Q1 and the correcting transistor Q2 are each connected to the input terminal 10, so that as an input voltage Vin varies, an emitter-collector voltage varies by (approximately) the same amount. That is, if the input voltage Vin varies, the current amplification factors $h_{FE1}$ and $h_{FE2}$ vary similarly owing to the early effect.

Figure 5:
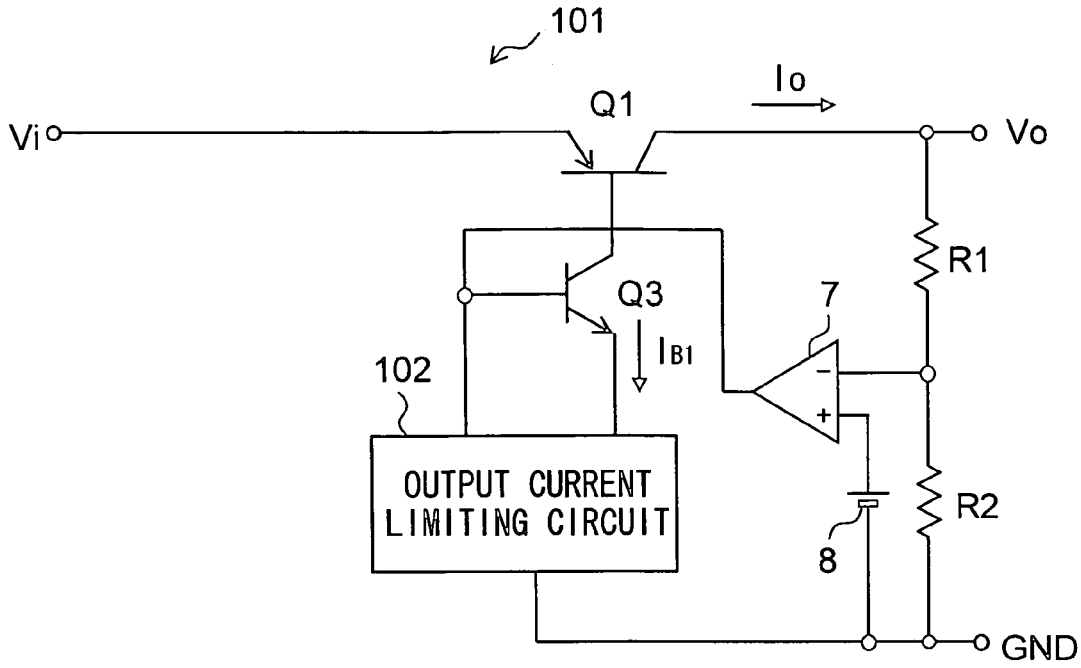
FIG.5 PRIOR ART
FIG. 5 is a circuit diagram of a conventional stabilized DC power supply circuit.
Figure 6:
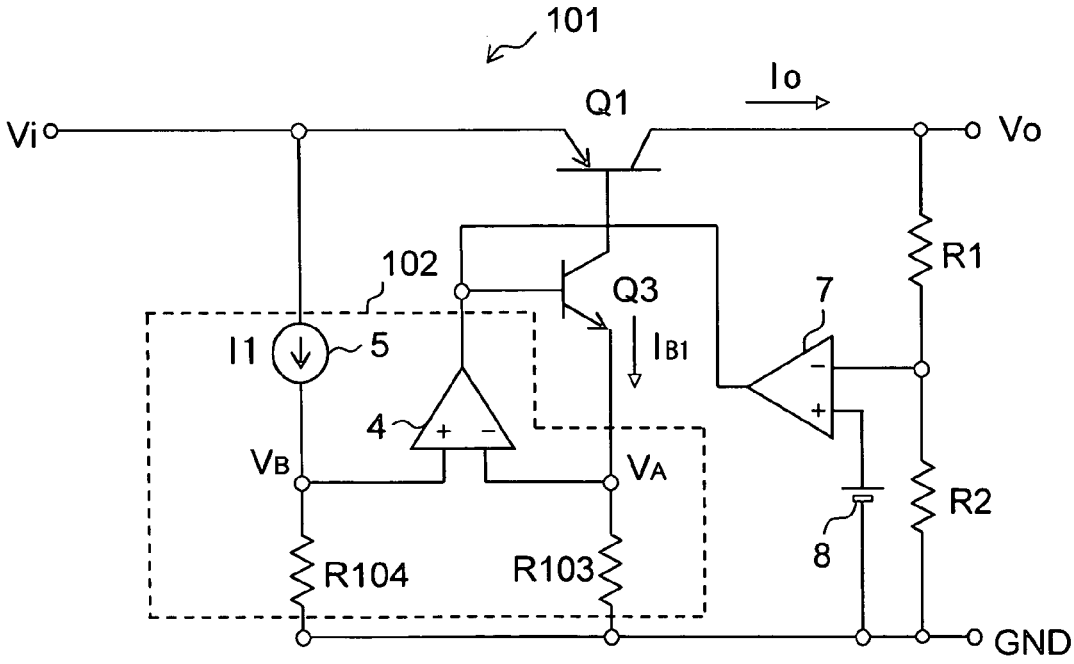
FIG.6 PRIOR ART
FIG. 6 is a detailed circuit diagram of the conventional stabilized DC power supply circuit of FIG. 5.

If the current amplification factor $h_{FE1}$ becomes relatively small due to variation of the manufacturing processes, variation in ambient temperature, variation in input voltage Vi, etc., a magnitude of the base current $I_{B1}$ at the same output current Io becomes relatively large but the current amplification factor $h_{FE2}$ also becomes relatively small similarly, so that a magnitude of the collector current $I_{C2}$ of the correcting transistor Q2 becomes relatively small. That is, the base current $I_{B1}$ of the output transistor Q1 and the collector current $I_{C2}$ of the correcting transistor Q2 vary in the opposite directions, so that as the current amplification factor $h_{FE1}$ varies, the detection potential V1 varies smaller than the cases of conventional examples shown in FIGS. 5 and 6 respectively.

In such a manner, by the power supply circuit 1, variation in output peak current $I_{OP}$ (error from an established target value) that occur corresponding to variation in current amplification factor $h_{FE1}$ is corrected (suppressed).

In the present embodiment, the base current $I_{B1}$ of the output transistor Q1 functions as a detecting current for the purpose of detecting the output current Io, while the collector current $I_{C2}$ of the correcting transistor Q2 functions as a correcting current. Based on these detecting current and correcting current, the output current limiting circuit 2 limits the output current Io. It is to be noted that of course the current amplification factor $h_{FE1}$ represents a relationship between a physical quantity of a base current flowing from the base electrode, which is a control electrode of the output transistor Q1, and a collector current (magnitude of the output current Io) of the output transistor Q1.

Second Embodiment

Figure 2:
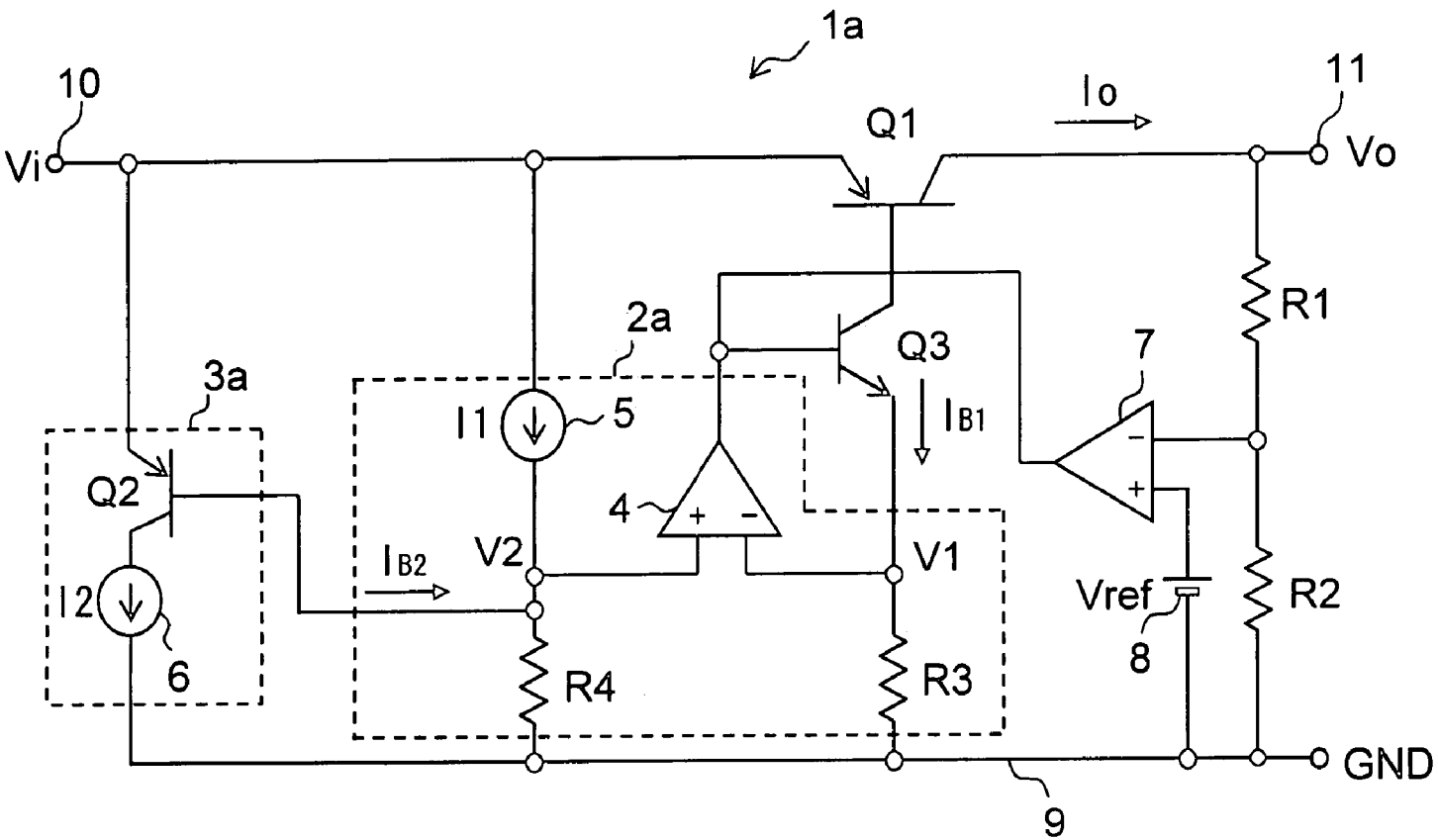
FIG. 2 is a circuit diagram of a stabilized DC power supply circuit according to a second embodiment of the present invention.

The following will describe a second embodiment of a stabilized DC power supply circuit (stabilized DC power supply unit) according to the present invention. FIG. 2 is a circuit diagram of a stabilized DC power supply circuit la (hereinafter, referred to as "power supply circuit 1a" simply) according to the second embodiment. In FIG. 2, the same components as those of FIG. 1 are indicated by the same reference numerals, to omit duplicated description of the same components in principle.

The power supply circuit 1*a* includes an output transistor Q1, a driving transistor Q3, an output current limiting circuit 2*a* for limiting a magnitude of an output current Io of the power supply circuit 1*a*, a correction circuit 3*a* for correcting (suppressing) variation in magnitude of the output current Io limited by the output current limiting circuit 2*a*, voltage division resistors R1 and R2, an error amplifier 7, and a reference voltage source 8. That is, the power supply circuit 1*a* has the same circuit configuration and operations as those of the power supply circuit 1 of FIG. 1 except that the output current limiting circuit 2 and the correction circuit 3 in the power supply circuit 1 of FIG. 1 are replaced with the output current limiting circuit 2*a* and the correction circuit 3*a*, respectively. In the following explanation, attention is focused on differences from the power supply circuit 1, to omit description about the same points.

Like the correction circuit 3 of FIG. 1, the correction circuit 3*a* includes a correcting transistor Q2 and a constant current source 6. However, in the correcting transistor Q2 in the correction circuit 3*a*, its emitter is connected to an input terminal 10, its base is connected to a non-inverting input terminal (+) of a differential amplifier 4, and its collector is connected to an input side of the constant current source 6. An output side of the constant current source 6 in the correction circuit 3*a* is connected to a ground line 9. That is, a collector current of the correcting transistor Q2 provides a constant current I2 and is configured not to be influenced by variation of semiconductor manufacturing processes and a change in ambient temperature.

Like the output current limiting circuit 2 of FIG. 1, the output current limiting circuit 2*a* includes a differential amplifier 4, a constant current source 5, and resistors R3 and R4 and has the same connections therebetween as those of the output current limiting circuit 2 of FIG. 1. However, in contract to the output current limiting circuit 2 of FIG. 1 in which the collector of the correcting transistor Q2 has been connected to the inverting input terminal (−) of the differential amplifier 4, in the output current limiting circuit 2*a*, as described above, a base of the correcting transistor Q2 is connected to the non-inverting input terminal (+) of the differential amplifier 4.

Therefore, by ignoring a base current of the driving transistor Q3 and representing a base current of the correcting transistor Q2 by $I_{B2}$, a detection potential V1 and a reference potential V2 can be given by the following Equations (4) and (5), respectively.

$$V1=I_{B1}\times R3=Io/h_{FE1}\times R3 \quad (4)$$

$$V2=(I1+I_{B2})\times R4=(I1+I2/h_{FE2})\times R4 \quad (5)$$

Since the output transistor Q1 and the correcting transistor Q2 have characteristics similarity α as described above, current amplification factors $h_{FE1}$ and $h_{FE2}$ are similarly influenced by variation of the semiconductor manufacturing processes and variation in ambient temperature. Furthermore, emitters of the output transistor Q1 and the correcting transistor Q2 are each connected to the input terminal 10, so that as an input voltage Vin varies, an emitter-collector voltage varies by (approximately) the same amount. That is, if the input voltage Vin varies, the current amplification factors $h_{FE1}$ and $h_{FE2}$ vary similarly owing to the early effect.

Therefore, if the current amplification factor $h_{FE1}$ becomes relatively small due to variation of the manufacturing processes, variation in ambient temperature, variation in input voltage Vi, etc., a magnitude of a base current $I_{B1}$ at the same output current Io becomes relatively large to increase the detection potential V1. In this case, on the other hand, the current amplification factor $h_{FE2}$ also becomes relatively small similarly, so that a magnitude of the base current $I_{B2}$ as a correcting current of the correcting transistor Q2 becomes relatively large to increase the reference potential V2 also. That is, the detecting potential V1 and the reference potential V2 change similarly in response to a variation in current amplification factor $h_{FE1}$, thereby correcting (suppressing) variation (error from an established target value) in output peak current $I_{OP}$ that occur corresponding to variation in current amplification factor $h_{FE1}$.

Further, in the first, second, and later-described all other embodiments, the resistors R3 and R4 may be manufactured in the same manufacturing processes. For example, in a case where an entirety of the power supply circuit 1 or 1*a* or the resistors R3 and R4 are formed on a semiconductor substrate, the resistors R3 and R4, which are formed through diffusion etc. of an impurity, vary in electrical characteristics (resistance value and temperature coefficient) owing to variation etc. of diffusion quantities of the impurity and in different directions and by different amounts with different manufacturing steps etc.

Although it is impossible to reduce to zero variation in electrical characteristics of the resistors caused by variation of the manufacturing processes, by manufacturing the resistors R3 and R4 through the same manufacturing processes such as impurity diffusion quantities and manufacturing steps, these resistors are influenced similarly by variation of the manufacturing processes and the ambient temperature, thereby reducing variation in output peak current $I_{OP}$ caused by difference in variation in characteristics between the resistors R3 and R4. For example, the resistors R3 and R4 may be formed on the same semiconductor substrate simultaneously.

Further, in the first, second, and later-described all other embodiments, the same type of the resistors R3 and R4 may be provided. Also, the resistors R3 and R4 may be made identical. For example, when an entirety of the power supply circuit 1 or 1*a* or the resistors R3 and R4 are formed on a semiconductor substrate, the resistors R3 and R4, which are formed through diffusion etc. of an impurity, may have the same diffusion quantities of the impurity and the same shape, size, etc. of portions where the resistors are formed.

By manufacturing the resistors R3 and R4 to be of the same type, they are influenced similarly by variation of the manufacturing processes and the ambient temperature, thereby reducing variation in output peak current $I_{OP}$ caused by different variation in characteristics of the resistors R3 and R4.

Further, in the first, second, and later-described all other embodiments, the resistors R3 and R4 may be a variable resistor whose resistance value can be changed in accordance with an external signal etc. By manufacturing the resistors R3 and R4 as such a variable resistor, it is possible to bring the resistance values of the resistors R3 and R4 closer to a design value. That is, it is possible to greatly reduce variation in resistance value caused by variation etc. of the manufacturing processes, thus resulting in further decreased variation in output peak current $I_{OP}$.

Figure 3:
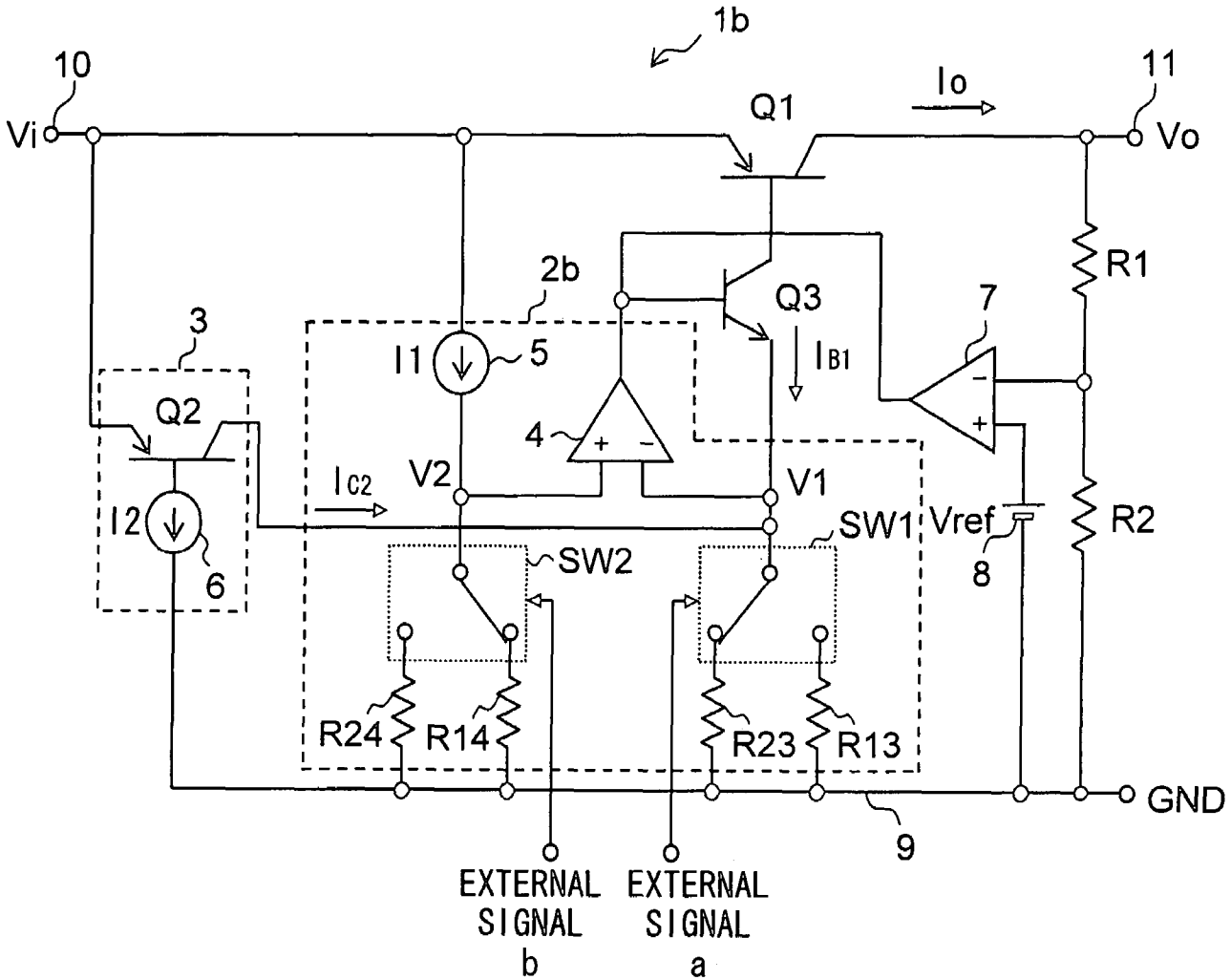
FIG. 3 is a circuit diagram showing a modification of the stabilized DC power supply circuit of FIG. 1.

FIG. 3 shows a circuit diagram of a stabilized DC power supply circuit 1*b* (hereinafter, referred to as "power supply circuit 1b" simply) in which the resistors R3 and R4 in the power supply circuit 1 of FIG. 1 are modified into a variable resistor. They can be modified similarly also in the power supply circuit 1*a* of FIG. 2. In FIG. 3, the same components as those of FIG. 1 are indicated by the same reference numerals, to omit duplicated description of the same components in principle. The power supply circuit 1*b* has the same circuit configuration and operations as those of the power supply circuit 1 of FIG. 1 except that the output current limiting circuit 2 in the power supply circuit 1 of FIG. 1 is replaced with the output current limiting circuit 2*b*. In the following explanation, attention is focused on differences from the power supply circuit 1, to omit description about the same points.

As can be seen from comparison between FIGS. 1 and 3, in the power supply circuit 1*b* of FIG. 3, the resistor R3 in FIG. 1 is replaced with resistors R13 and R23 and a switch circuit SW1 and the resistor R4 in FIG. 1 is replaced with resistors R14 and R24 and a switch circuit SW2.

The switch circuit SW1 connects the resistor R13 or R23 to the inverting input terminal (−) of the differential amplifier 4 in accordance with a signal level of "an external signal a" supplied from an outside. The inverting input terminal (−) of the differential amplifier 4 is connected to the ground line 9 via the resistor (that is, the resistor R13 or R23) connected by the switch circuit SW1. The switch circuit SW2 connects the resistor R14 or R24 to the non-inverting input terminal (+) of the differential amplifier 4 in accordance with a signal level of "an external signal b" supplied from the outside. The non-inverting input terminal (+) of the differential amplifier 4 is connected to the ground line 9 via the resistor (that is, the resistor R14 or R24) connected by the switch circuit SW2.

It is to be noted that in the first, second, and later-described all other embodiments, the resistors R3 and R4 may be manufactured as the same type of variable resistors through the same manufacturing processes. For example, the resistors R13, R23, R14, and R24 may be all manufactured as the same type of resistors through the same manufacturing processes.

Figure 8:
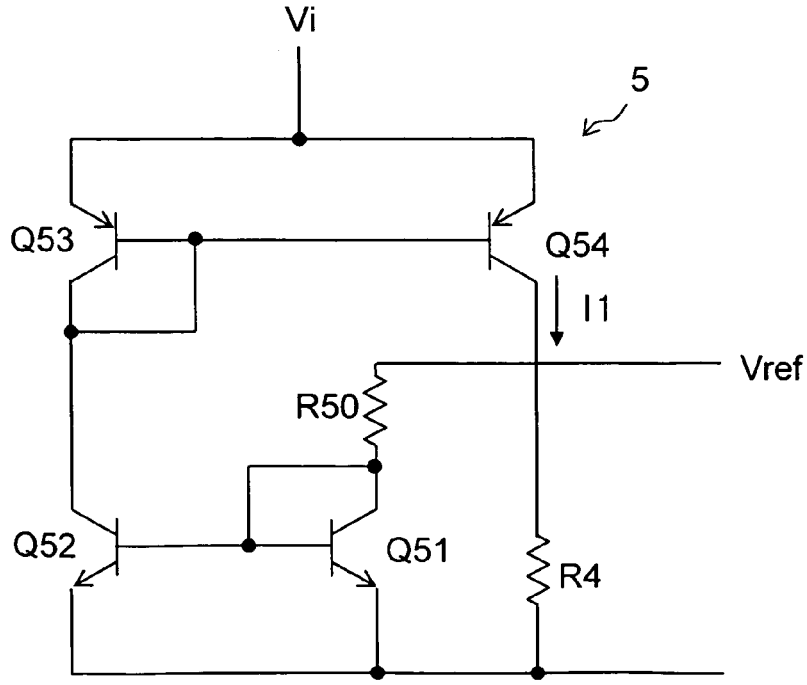
FIG. 8 is a circuit diagram of a constant current source of FIG. 1 etc.

FIG. 8 shows a circuit example of the constant current source 5 used in FIG. 1 etc. In FIG. 8, the constant current source 5 includes four transistors Q51, Q52, Q53, and Q54 and one resistor R50. In FIG. 8, the resistor R50 is supplied, at its one end, with a reference voltage Vref output from a reference voltage source 8 and the transistors Q53 and Q54 are supplied with the input voltage Vi at their emitters (see FIG. 1 etc.). With this, a constant current I1 flows from a collector of the transistor Q54 toward the resistor R4.

If a constant current is used in such a manner in the output current limiting current or the correction circuit, the power supply circuit as a whole has larger power dissipation and a larger number of components, thus increasing costs of an integrated circuit (IC) equipped with the power supply circuit. In this viewpoint, as a power supply circuit that includes a small number of components and requires no constant current, power supply circuits of third to fifth embodiments are described below.

Third Embodiment

Figure 9:
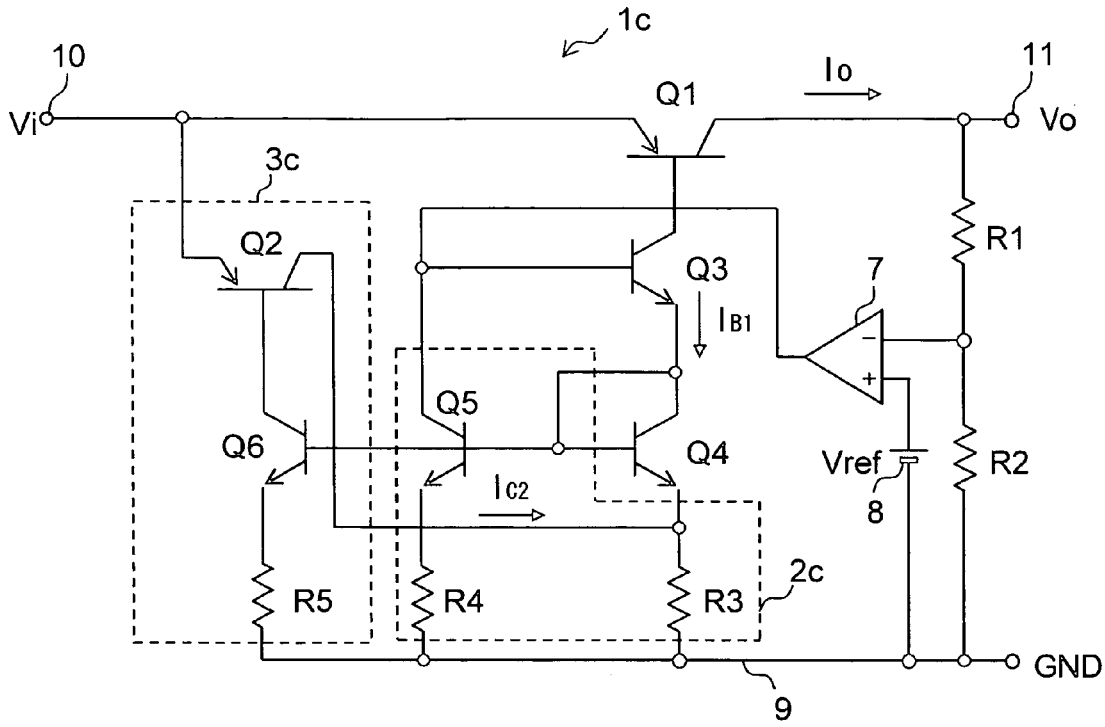
FIG. 9 is a circuit diagram of a stabilized DC power supply circuit according to a third embodiment of the present invention.

First, a stabilized DC power supply circuit (stabilized DC power supply unit) according to the third embodiment is described as follows. FIG. 9 is a circuit diagram of a stabilized DC power supply circuit 1*c* (hereinafter, referred to as "power supply circuit 1c" simply) according to the third embodiment. In FIG. 9, the same components as those of FIG. 1 etc. are indicated by the same reference numerals, to omit duplicated description of the same components in principle.

The power supply circuit 1*c* includes an output transistor Q1, a driving transistor Q3, "an output current limiting circuit 2c constituted of a transistor Q5, and resistors R3 and R4", "a correction circuit 3c constituted of a correcting transistor Q2, a transistor Q6, and a resistor R5", a transistor Q4, voltage dividing resistors R1 and R2, an error amplifier 7, and a reference voltage source 8. The transistor Q4 can be thought of as a component of the output current limiting circuit 2*c* and also as a component of the correction circuit 3*c*. The transistors Q4, Q5, and Q6 are each an NPN-type bipolar transistor. As described above, the output transistor Q1 and the correcting transistor Q2 are formed to have a characteristics similarity $\alpha$.

An input terminal 10 is supplied with an input voltage Vi (e.g., 12 VDC), which is a voltage-to-be-stabilized from an outside. The input terminal 10 is commonly connected to an emitter of the correcting transistor Q2 and an emitter of the output transistor Q1.

A collector of the output transistor Q1 is connected to an output terminal I1 to which an output voltage Vo of the power supply circuit 1*c* is to be provided and also to a ground line 9 held to 0-V potential (GND) via a series circuit including the voltage dividing resistors R1 and R2. In the error amplifier 7, its inverting input terminal (−) is supplied with a potential of a node between the voltage dividing resistors R1 and R2 and its non-inverting input terminal (+) is supplied with a reference potential Vref output by the reference voltage source 8.

As for the driving transistor Q3, its collector is connected to a base of the output transistor Q1, its base is commonly connected to an output terminal of the error amplifier 7 and a collector of the transistor Q5, and its emitter is connected to a collector and a base of the transistor Q4 that are short-circuited. Emitters of the transistors Q4, Q5, and Q6 are connected to the ground line 9 via the resistors R3, R4, and R5 respectively and bases of the transistors Q4, Q5, and Q6 are commonly connected.

The transistors Q4 and Q5 constitute a current mirror circuit (detecting current mirror circuit) for providing, as a collector current of the transistor Q5, a current obtained by proportionally multiplying a collector current of the transistor Q4 flowing on the input side of the current mirror circuit, that is, a base current $I_{B1}$ of the output transistor Q1.

The transistors Q4 and Q6 constitute a current mirror circuit (correcting current mirror circuit) for providing, as a collector current of the transistor Q6, a current obtained by proportionally multiplying a collector current of the transistor Q4 flowing on the input side of the current mirror circuit, that is, a base current $I_{B1}$ of the output transistor Q1. As for the correcting transistor Q2, its base is connected to a collector of the transistor Q6 and its collector is connected to a node between the emitter of the transistor Q4 and the resistor R3.

In the thus configured power supply circuit 1*c*, if the base current $I_{B1}$ of the output transistor Q1 increases as an increasing output current Io, the transistor Q5, which is combined with the transistor Q4 to constitute the current mirror circuit, starts to draw out a current from the error amplifier 7 until no current is finally supplied from the error amplifier 7 to the base of the driving transistor Q3. In such a manner, the output current limiting circuit 2*c* in the power supply circuit 1*c* works to limit the base current $I_{B1}$ of the output transistor Q1, thereby restricting the output current Io.

Further, since the transistors Q4 and Q6 constitute the current mirror circuit, if the base current $I_{B1}$ of the output transistor Q1 increases as the increasing output current Io, a collector current of the transistor Q6, that is, a base current of the correcting transistor Q2 increases. Accordingly, a collector current $I_{C2}$ of the correcting transistor Q2 as a correcting current increases, to increase an emitter potential of the transistor Q4. As a result, base potentials of the transistors Q5 (and Q4 and Q6) rise so that the transistor Q5 may start to draw out a current from the error amplifier 7, thereby restricting the base current $I_{B1}$ of the output transistor Q1 (more than the case of a circuit of FIG. 7).

That is, as the output current Io increases, the correction circuit 3*c* works to limit an increase in output current Io more, so that a threshold current value at which the output current limiting circuit 2*c* starts to limit an increase in output current Io, that is, an output peak current comes not to be influenced so much by variation in current amplification factor $h_{FE1}$ caused by variation of the manufacturing processes, changes in temperature, and variation in input voltage Vi. Therefore, the output current Io increases, to greatly reduce a risk of destruction of an IC chip itself or an electronic apparatus equipped with the power supply circuit 1*c*.

The following will describe in detail a relationship between variation in current amplification factor $h_{FE1}$ and that in output peak current $I_{OP2}$ by representing, by $I_{OP2}$, a threshold current value at which the output current limiting circuit 2*c* according to the present embodiment starts to limit an increase in output current Io, that is, an output peak current.

It is here supposed that if a base potential of the transistor Q5 takes on a value of 0.9 V (volt), a current (or part of current) which has been supplied from the error amplifier 7 to the base of the transistor Q3 flows toward the transistor Q5, thereby limiting the output current Io. Further, in this case, an emitter potential of the transistor Q4 is supposed to be 0.2V. That is, it is supposed that if the output current Io equals the output peak current $I_{OP2}$, the emitter potential of the transistor Q4 takes on a value of 0.2 V.

It is to be noted that in this case the base current of the transistor Q3 is $I_{B1}/h_{FE3}=(I_{OP2}/h_{FE1})/h_{FE3}$ (where $h_{FE3}$ is a current amplification factor of the transistor Q3). There is a limit to in increase in output current of the error amplifier 7, so that the output peak current $I_{OP2}$ refers to an output current Io in a condition where "a total sum of a collector current of the transistor Q5 (current drawn out by the differential amplifier 4 in the first embodiment etc.) and a base current of the transistor Q3" equals "a maximum value of the output current of the error amplifier 7" owing to an increase in output current Io.

If the emitter potential of the transistor Q4 is 0.2 V, the following Equation (6) is established where a resistance value of the resistor R3 is indicated by R3, and if an emitter area of the transistor Q6 is 1/100 of that of the transistor Q4, a collector current of the transistor Q6 is 1/100 of that of the transistor Q4, so that the following Equation (7) is established.

$$0.2=(I_{B1}+I_{C2})\times R3 \quad (6)$$

$$0.2=\{I_{B1}+(I_{B1}/100)\times h_{FE2}\}\times R3 \quad (7)$$

In Equation (7), by substituting R3=40Ω (ohm) and $I_{B1}=I_{OP2}/h_{FE1}$, the following Equation (8) is obtained.

$$0.2=\{I_{OP2}/h_{FE1}+(I_{OP2}\times h_{FE2})/(h_{FE1}\times 100)\}\times 40 \quad (8)$$

Unavoidable variation in current amplification factor $h_{FE1}$ of the output transistor Q1 is supposed to be in a range of $100 \leqq h_{FE1} \leqq 200$. In the conventional circuit example of FIG. 7, if a resistance value of the resistor R103 is supposed to be 100Ω, the output peak current varies in a range of 200 to 400 mA because 0.2 V/100Ω=2 mA.

On the other hand, in the power supply circuit 1*c* of FIG. 9, in a case where $h_{FE1}$ varies in a range of $100 \leqq h_{FE1} \leqq 200$, if a relationship of $h_{FE1}=h_{FE2}$ is supposed because the output transistor Q1 and the correcting transistor Q2 have a characteristics similarity α, based on Equation (8) the output peak current $I_{OP2}$ varies in a range of 250 to about 333 mA.

If it is supposed that a ratio of an emitter area of the transistor Q4 to that of the transistor Q6 is Y and an emitter potential of the transistor Q4 in a condition where a current (part of current) which has been supplied from the error amplifier 7 to the base of the transistor Q3 flows toward the transistor Q5 is V3, Equation (8) is generalized and modified into the following Equation (9).

$$I_{OP2}=(V3\times h_{FE1}\times Y)/\{R3\times(Y+h_{FE2})\} \quad (9)$$

Equation (9) also tells that if $h_{FE1}$ and $h_{FE2}$ have the same tendency, the output peak current $I_{OP2}$ varies less.

Fourth Embodiment

Figure 10:
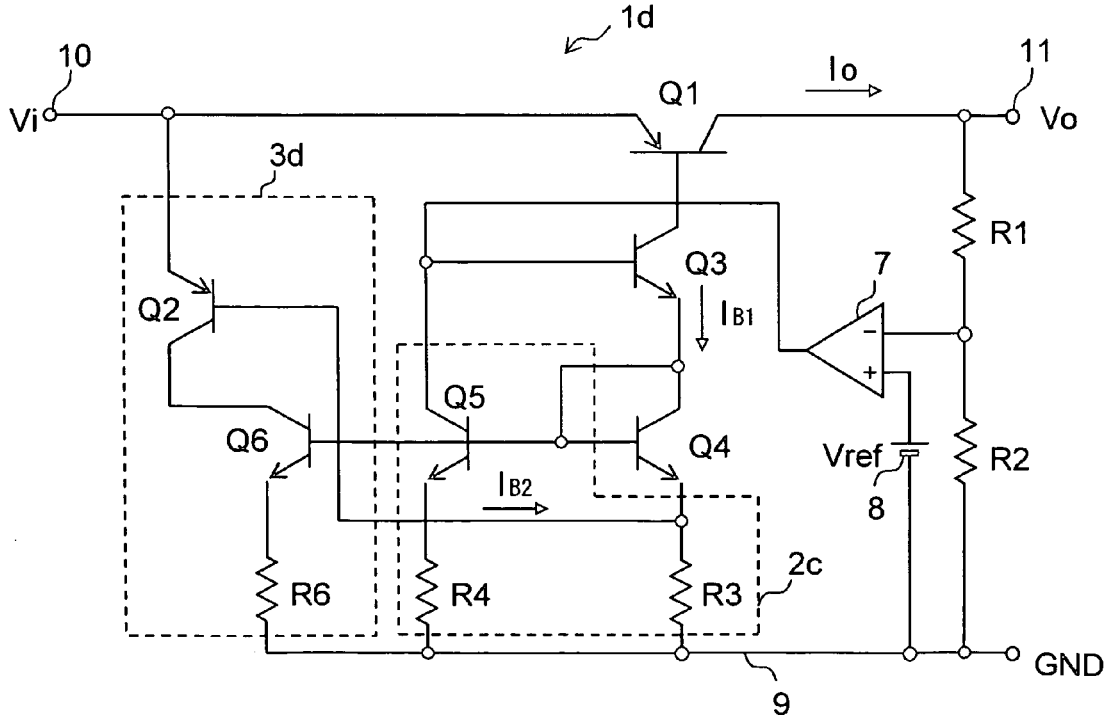
FIG. 10 is a circuit diagram of a stabilized DC power supply circuit according to a fourth embodiment of the present invention.

The following will describe the fourth embodiment of the present invention as a modification of the third embodiment. FIG. 10 is a circuit diagram of a stabilized DC power supply circuit 1*d* (hereinafter, referred to as "power supply circuit 1d" simply) according to the fourth embodiment. In FIG. 10, the same components as those of FIGS. 1, 9, etc. are indicated by the same reference numerals, to omit duplicated description of the same components in principle.

The power supply circuit 1*d* has the same circuit configuration and operations as those of the power supply circuit 1*c* except that the correction circuit 3*c* in the power supply circuit 1*c* of FIG. 9 is replaced with a correction circuit 3*d*. In the following explanation, attention is focused on differences from the power supply circuit 1*c*, to omit description about the same points.

The correction circuit 3*d* includes a correcting transistor Q2 that has a characteristics similarity α in relation to an output transistor Q1, a transistor Q6, and a resistor R6. As for the correcting transistor Q2, its emitter is commonly connected to an input terminal 10 and an emitter of the output transistor Q1, its base is connected to a node between a transistor Q4 and a resistor R3, and its collector is connected to a collector of a transistor Q6.

As for the transistor Q6, its base is commonly connected to bases of the transistors Q4 and Q5 and its emitter is connected to a ground line 9 via a resistor R6. In such a manner, in the present embodiment also, the transistors Q4 and Q6 constitute a current mirror circuit (correcting current mirror circuit) for providing, as a collector current of the transistor Q6, a current obtained by proportionally multiplying a collector current of the transistor Q4, that is, a base current $I_{B1}$ of the output transistor Q1.

The power supply circuit 1*d* of FIG. 10 operates in almost the same way as the power supply circuit 1*c* of FIG. 9. That is, if the base current $I_{B1}$ of the output transistor Q1 increases as the increasing output current Io, a collector current of the transistor Q6, that is, an emitter current of the transistor Q2 increases. Accordingly, a base current $I_{B2}$ of the transistor Q2 as a correcting current increases, to increase an emitter potential of the transistor Q4. As a result, base potentials of the transistors Q5 (and Q4 and Q6) rise so that the transistor Q5 may start to draw out a current from the error amplifier 7, thereby restricting the base current $I_{1B}$ of the output transistor Q1 (more than the case of a circuit of FIG. 7).

That is, as the output current Io increases, the correction circuit 3*d* works to limit an increase in output current Io more, so that a threshold current value at which the output current limiting circuit 2*c* starts to limit an increase in output current Io, that is, an output peak current comes not to be influenced so much by variation in current amplification factor $h_{FE1}$ caused by variation of the manufacturing processes, changes in temperature, and variation in input voltage Vi.

Figure 4A:
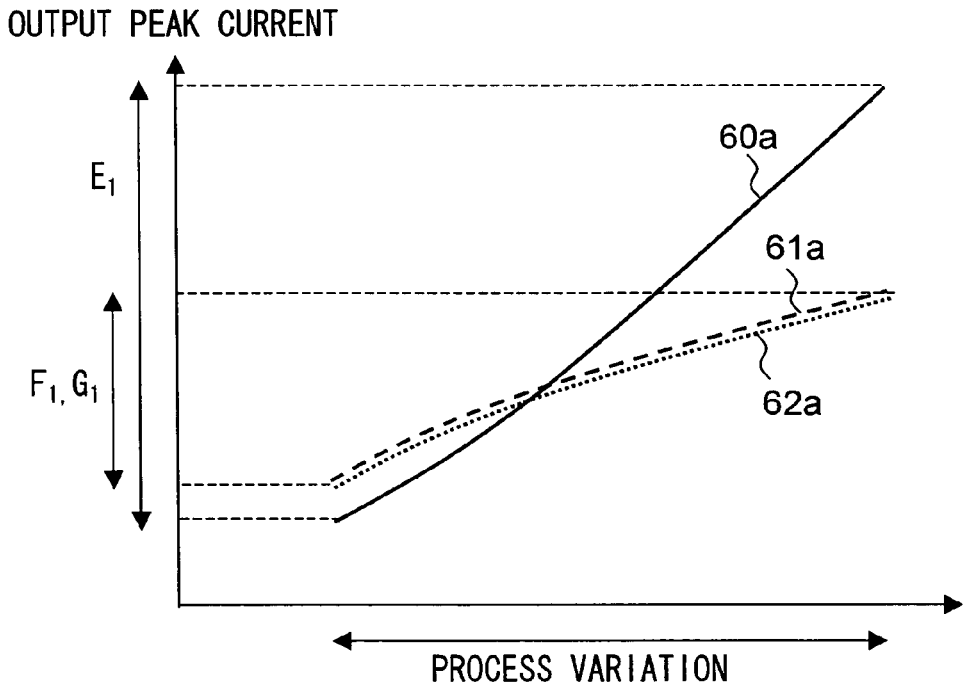
FIG. 4 is a graph showing a variation factor-dependency of an output peak current in a conventional stabilized DC power supply circuit and the stabilized DC power supply circuit according to the present invention.
Figure 4B:
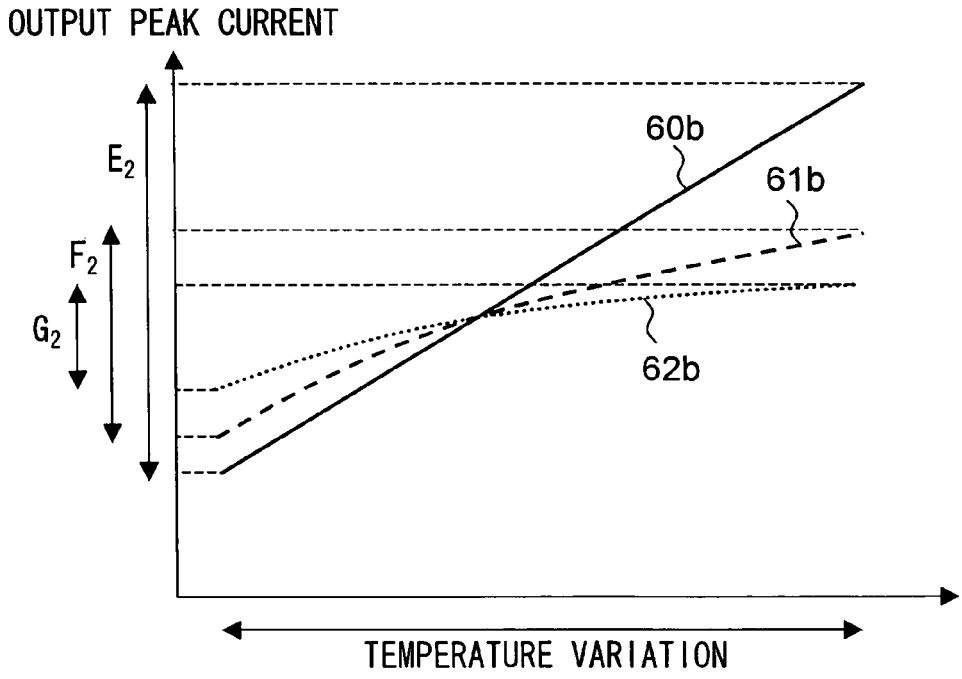

FIGS. 4A and 4B show a variation factor-dependency of an output peak current ($I_{OP}$ or $I_{OP2}$) in the conventional power supply circuits (see FIGS. 5 to 7) and the power supply circuits according to the present invention. A horizontal axis of FIG. 4A represents a degree of variation of manufacturing processes and a horizontal axis of FIG. 4B represents an ambient temperature of the power supply circuit. Vertical axes of FIGS. 4A and 4B each represent the output peak current ($I_{OP}$ or $I_{OP2}$).

In FIG. 4A, a solid line 60*a* and broken lines 61*a* and 62*a* show a manufacturing process variation-dependency of the output peak current ($I_{OP}$ or $I_{OP2}$), the solid line 60*a* of which shows this dependency in the conventional power supply circuit, the broken line 61*a* of which shows this dependency in the power supply circuits 1, 1*a*, and 1*b*, and the broken line 62*a* of which shows this dependency in the power supply circuits 1*c* and 1*d*. In FIG. 4B, a solid line 60*b* and broken lines 61*b* and 62*b* show an ambient temperature-dependency of the output peak current ($I_{OP}$ or $I_{OP2}$), the solid line 60*b* of which shows this dependency in the conventional power supply circuit, the broken line 61*b* of which shows this dependency in the power supply circuits 1, 1*a*, and 1*b*, and the broken line 62*b* of which shows this dependency in the power supply circuits 1*c* and 1*d*.

As shown in FIGS. 4A and 4B, effective values $F_1$ and $F_2$ of variation in output peak current in the power supply circuits 1, 1*a*, and 1*b* are smaller than effective values $E_1$ and $E_2$ of variation in output peak current in the conventional power supply circuits. Further, effective values $G_1$ and $G_2$ of variation in output peak current in the power supply circuits 1*c* and 1*d* are further small because they are less influenced by variation factors as described above. Therefore, by applying the present invention, a range of a specification value of the output peak current can be narrowed and, as a result, costs and a size of an electronic apparatus as a whole can be reduced. It is to be noted that power supply circuits 1*e* and 1*f* of the respective fifth and sixth embodiments to be described later have almost the same small variation in output peak current as (or smaller variation than) the power supply circuits 1*c* and 1*d*.

Fifth Embodiment

Figure 11:
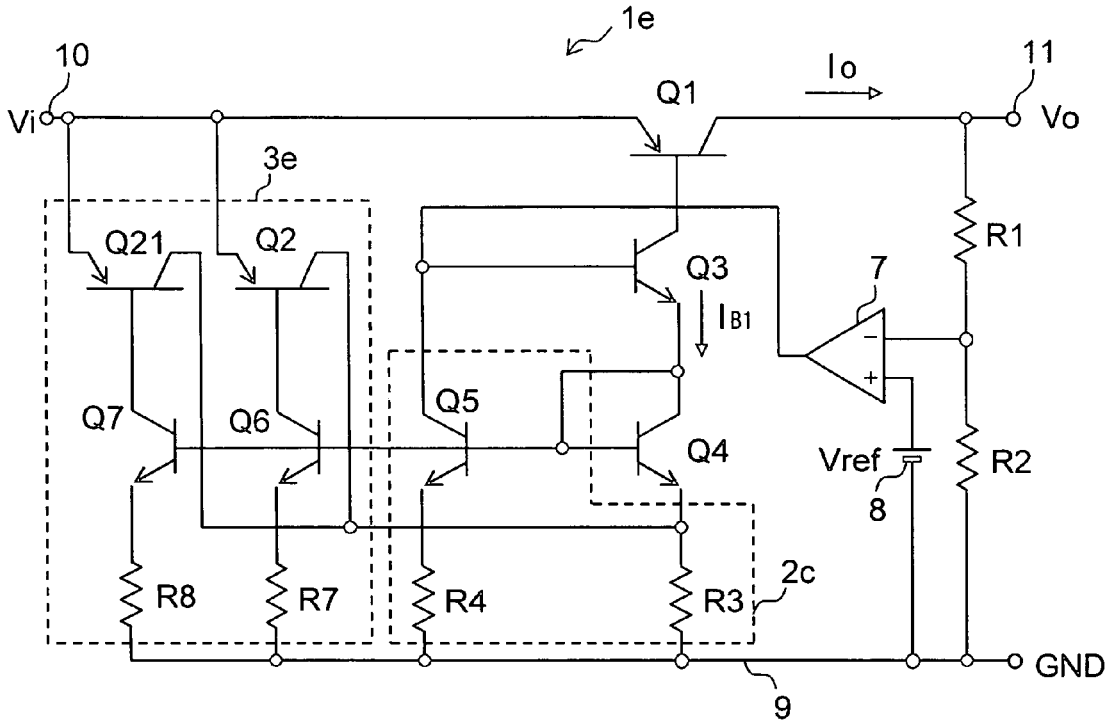
FIG. 11 is a circuit diagram of a stabilized DC power supply circuit according to a fifth embodiment of the present invention.

A correcting transistor may be made of a plurality of correcting transistors used in a modification of the third embodiment, which modification is described as the fifth embodiment below. FIG. 11 is a circuit diagram of a stabilized DC power supply circuit 1*e* (hereinafter, referred to as "power supply circuit 1e" simply) according to the fifth embodiment. In FIG. 11, the same components as those of FIGS. 1, 9, etc. are indicated by the same reference numerals, to omit duplicated description of the same components in principle.

The power supply circuit 1*e* has the same circuit configuration and operations as those of the power supply circuit 1*c* except that the correction circuit 3*c* in the power supply circuit 1*c* of FIG. 9 is replaced with a correction circuit 3*e*. In the following explanation, attention is focused on differences from the power supply circuit 1*c*, to omit description about the same points.

The correction circuit 3*e* includes correcting transistors Q2 and Q21, transistors Q6 and Q7, and resistors R7 and R8. The correcting transistor Q21 is identical to the correcting transistor Q2 and formed to have a characteristics similarity $\alpha$ in relation to an output transistor Q1. The transistor Q7 is an NPN-type bipolar transistor.

Emitters of the correcting transistors Q2 and Q21 are commonly connected to an input terminal 10 and also to an emitter of the output transistor Q1, and collectors of the correcting transistors Q2 and Q21 are commonly connected to a node between an emitter of the transistor Q4 and a resistor R3. Bases of the correcting transistors Q2 and Q21 are connected to collectors of the transistors Q6 and Q7, respectively. Emitters of the transistors Q6 and Q7 are connected to a ground line 9 via the resistors R7 and R8, respectively. Bases of the transistors Q4, Q5, Q6, and Q7 are connected to each other. The transistors Q6 and Q7 are combined with the transistor Q4 to configure a current mirror circuit (correcting current mirror circuit) that has the transistor Q4 on its current input side. It is to be noted that the transistors Q6 and Q7 may have the same emitter area or different emitter areas.

Figure 13:
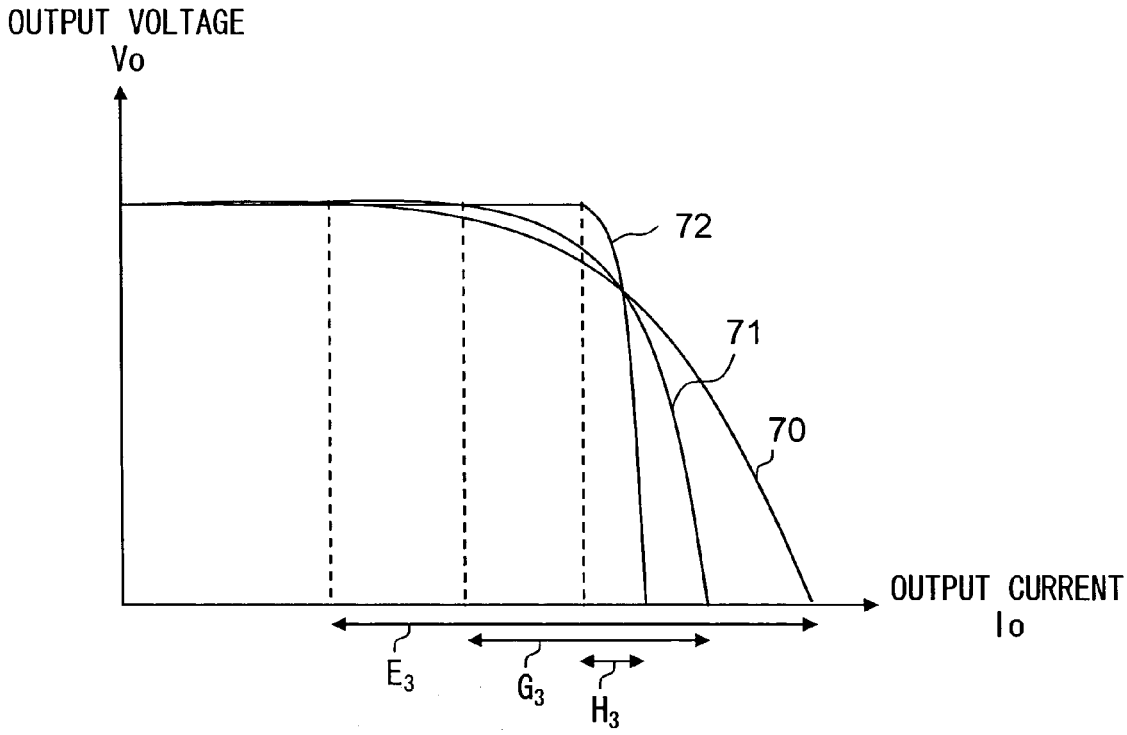
FIG. 13 is a graph showing a relationship between an output current and an output voltage of FIG. 1 etc.

FIG. 13 shows a relationship between an output current Io and an output voltage Vo. Curves 70, 71, and 72 each show a process from the output current Io increasing so that an output current limiting circuit may start to operate to the output current Io being completely limited so that the output voltage Vo may be reduced to zero, the curve 70 of which shows this process for the power supply circuit 201 of FIG. 7, the curve 71 of which shows this process for the power supply circuit 1*c* of FIG. 9, and the curve 72 of which shows this process for the power supply circuit 1*e* of FIG. 11.

Figure 7:
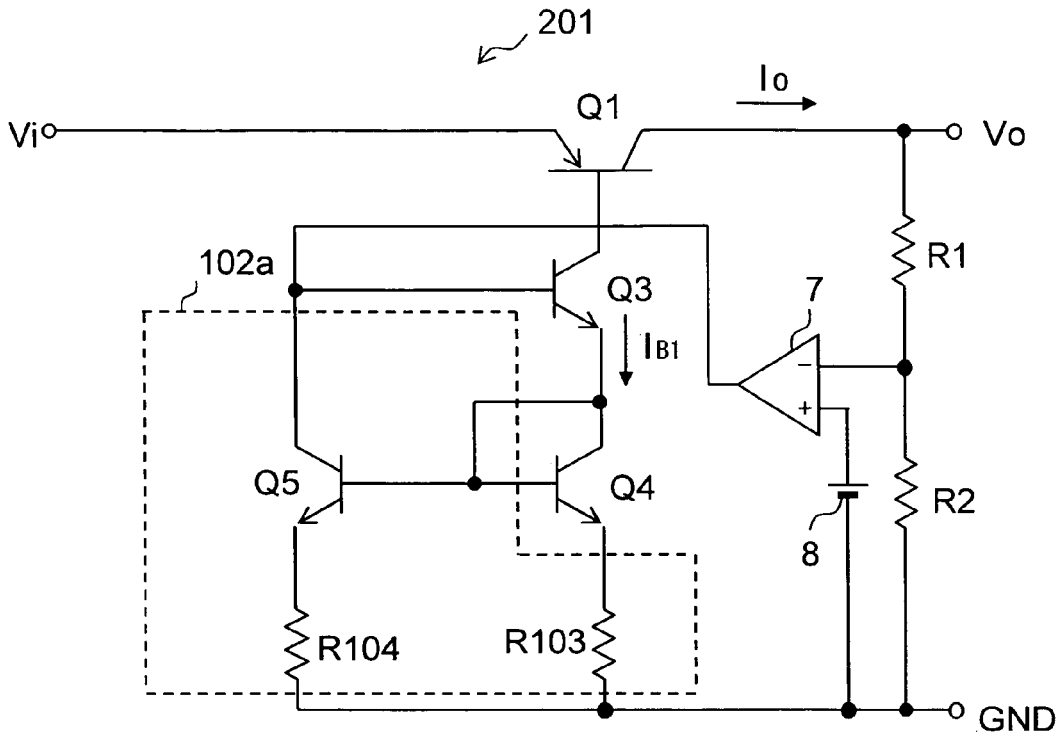
FIG.7 PRIOR ART
FIG. 7 is a circuit diagram of another conventional stabilized DC power supply circuit.

In the power supply circuit 201 of FIG. 7, if the output current Io starts to increase, the transistor Q5 starts to draw out an output current of the error amplifier 7, which is a differential amplifier. If the output current Io further increases to a certain current amount, the output current of the error amplifier 7 further increases, to unbalance an differential operation of the error amplifier 7, so that the output voltage Vo starts to decrease (a potential of the inverting input terminal (−) starts to decrease). If the output current Io further increases, finally, the output voltage Vo is reduced to zero. In FIG. 13, $E_3$ indicates a breadth of a value that the output current Io may take on in the power supply circuit 201 of FIG. 7 in a period from a moment when the output voltage Vo starts to decrease to a moment when it is reduced to zero.

In the power supply circuit 1*c* of FIG. 9, when the output voltage Vo starts to decrease due to an increase in output current Io, a collector current of the transistor Q6 starts to flow so that a collector current may flow through the correcting transistor Q2, thereby making a collector current of the transistor Q5 larger than that in the power supply circuit 201 of FIG. 7. Therefore, the output voltage Vo (potential of the inverting input terminal (−)) is reduced to zero in a condition where the output current Io is smaller than that in the power supply circuit 201 of FIG. 7. That is, in the power supply circuit 1*c*, a breadth $G_3$ of a value of the output current Io may take on in a period from a moment when the output current limiting circuit starts to operate to a moment when the output voltage Vo is reduced to zero is narrower than $E_3$.

In the power supply circuit 1*e* of FIG. 11, when the output voltage Vo starts to decrease due to an increase in output current Io, for example, collector currents of the transistors Q6 and Q7 start to flow simultaneously so that collector currents (correcting currents) may flow through the correcting transistors Q2 and Q21, thereby making a collector current of the transistor Q5 larger. Therefore, the output voltage Vo (potential of the inverting input terminal (−)) is reduced to zero in a condition where the output current Io is smaller than that in the power supply circuit 1*c* of FIG. 9. That is, in the power supply circuit 1*e*, a breadth $H_3$ of a value of the output current Io may take on in a period from a moment when the output current limiting circuit starts to operate to a moment when the output voltage Vo is reduced to zero is narrower than $G_3$.

If the breadth of the value that the output current Io may take on in a period from a moment when the output current limiting circuit starts to operate to a moment when the output voltage Vo is reduced to zero is large, the output peak current varies more, as described above, which breadth can be narrowed by the power supply circuit according to the present invention.

This breadth can be narrowed also by providing a plurality of elements to bear functions of the transistor Q5. That is, in FIG. 9 etc., the breadth can be narrowed also by providing, separately from the transistor Q5, at least one transistor (not shown) whose base is connected to the base of the transistor Q4, whose collector is connected to the base of the driving transistor Q3, and whose emitter is connected via a resistor (not shown) to the ground line 9.

Also, by providing a plurality of correcting transistors as in the case of the power supply circuit 1*e* of FIG. 11, a plurality of corrections can be conducted on variation in current amplification factor $h_{FE1}$ of the output transistor Q1, so that variation in output peak current can be reduced more with respect to variation in current amplification factor $h_{FE1}$.

Sixth Embodiment

Figure 12:
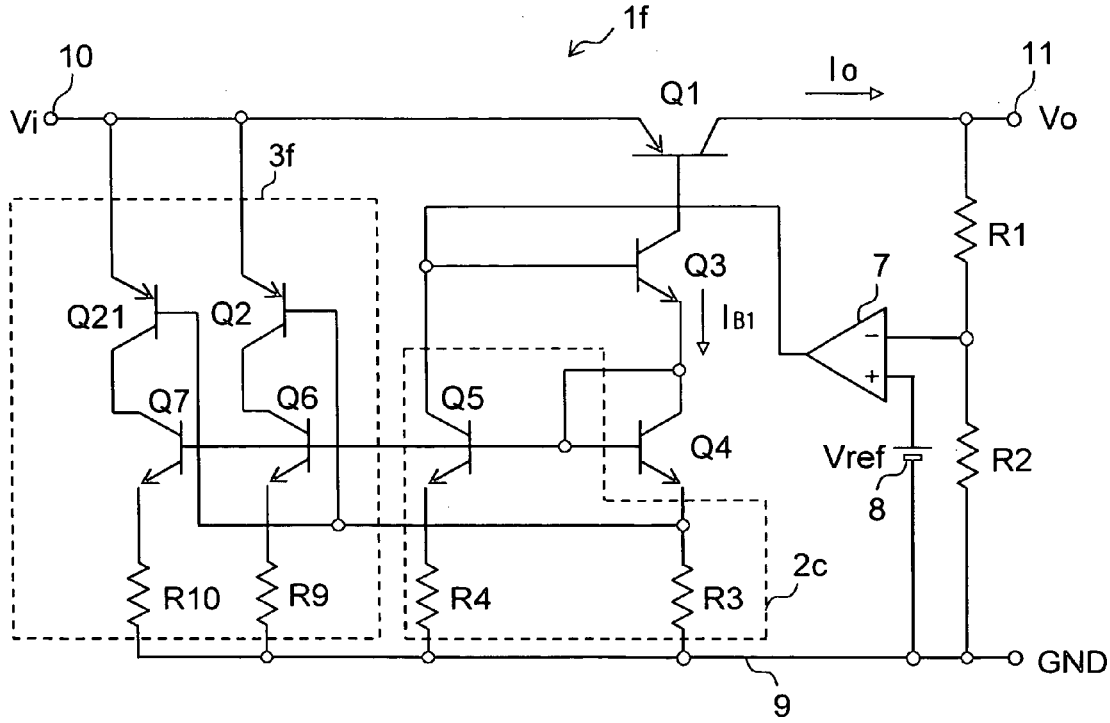
FIG. 12 is a circuit diagram of a stabilized DC power supply circuit according to a sixth embodiment of the present invention.

The following will describe a modification of the fourth embodiment that employs a plurality of correcting transistors, as the sixth embodiment. FIG. 12 is a circuit diagram of a stabilized DC power supply circuit 1*f* (hereinafter, referred to as "power supply circuit 1f" simply) according to the sixth embodiment. In FIG. 12, the same components as those of FIGS. 1, 9, 11, etc. are indicated by the same reference numerals, to omit duplicated description of the same components in principle.

The power supply circuit 1*f* has the same circuit configuration and operations as those of the power supply circuit 1*d* except that the correction circuit 3*d* in the power supply circuit 1*d* of FIG. 10 is replaced with a correction circuit 3*f*. The correction circuit 3*f* includes correcting transistors Q2 and Q21, transistors Q6 and Q7, and resistors R9 and R10.

In the power supply circuit 1*f*, emitters of the correcting transistors Q2 and Q21 are both connected to an input terminal 10 and also to an emitter of the output transistor Q1 commonly, and bases of the correcting transistors Q2 and Q21 are both connected to a node between an emitter of the transistor Q4 and a resistor R3. Collectors of the correcting transistors Q2 and Q21 are connected to collectors of the transistors Q6 and Q7, respectively. Emitters of the transistors Q6 and Q7 are connected to a ground line 9 via the resistors R9 and R10, respectively. Bases of the transistors Q4, Q5, Q6, and Q7 are connected to each other. In the power supply circuit 1*f* also, the transistors Q6 and Q7 are combined with the transistor Q4 to configure a current mirror circuit (correcting current mirror circuit) that has the transistor Q4 on its current input side.

By thus configuring the power supply circuit 1*f*, it is possible to obtain the same effects as those of the fifth embodiment.

Figure 14:
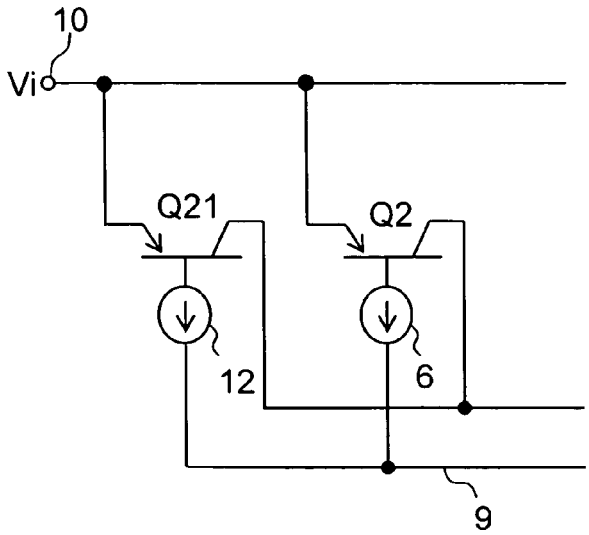
FIG. 14 is a circuit diagram showing a modification of part of a circuit of FIG. 1.

Further, in the first embodiment also, a plurality of correcting transistors may be provided. That is, for example, in the power supply circuit 1 of FIG. 1, as shown in FIG. 14, a correcting transistor Q21 whose emitter and collector are connected to the emitter and the collector of the correcting transistor Q2 respectively may be provided separately and a constant current source I2 may be connected to a base of the correcting transistor Q21 so that a base current of the correcting transistor Q21 may be constant. In this case, the collectors of the correcting transistors Q2 and Q21 are connected to the inverting input terminal (−) of the differential amplifier 4 of FIG. 1. It is to be noted that in FIG. 14 a magnitude of a constant current to the base of the correcting transistor Q2 and a magnitude of a constant current to the base of the correcting transistor Q21 may be the same or different from each other.

Figure 15:
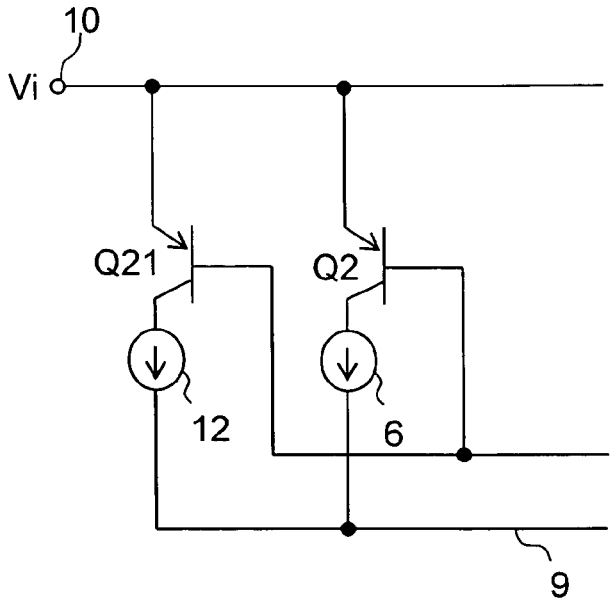
FIG. 15 is a circuit diagram showing a modification of part of a circuit of FIG. 2.

Similarly, in the second embodiment also, a plurality of correcting transistors may be provided. That is, for example, in the power supply circuit la of FIG. 2, as shown in FIG. 15, a correcting transistor Q21 whose emitter and base are connected to the emitter and the base of the correcting transistor Q2 respectively may be provided separately and the constant current source I2 may be connected to a collector of the correcting transistor Q21 so that a collector current of the correcting transistor Q21 may be constant. In this case, the bases of the correcting transistors Q2 and Q21 are connected to the non-inverting input terminal (+) of the differential amplifier 4 of FIG. 2. It is to be noted that in FIG. 15 a magnitude of a constant current to the collector the correcting transistor Q2 and a magnitude of a constant current to the collector of the correcting transistor Q21 may be the same or different from each other.

In the first and second embodiments, by providing a plurality of correcting transistors, a plurality of corrections can be conducted on variation in current amplification factor $h_{FE1}$ of the output transistor Q1, so that variation in output peak current can be reduced more with respect to variation in current amplification factor $h_{FE1}$. It is to be noted that in FIGS. 14 and 15, the same components as those in the other figures are indicated by the same reference numerals.

Seventh Embodiment

Although the first to sixth embodiments have exemplified a power supply circuit that employs a bipolar transistor as an output transistor etc., the present invention can be applied similarly also to a case where a field effect transistor such as a metal oxide semiconductor field effect transistor (MOSFET) is used.

Figure 17:
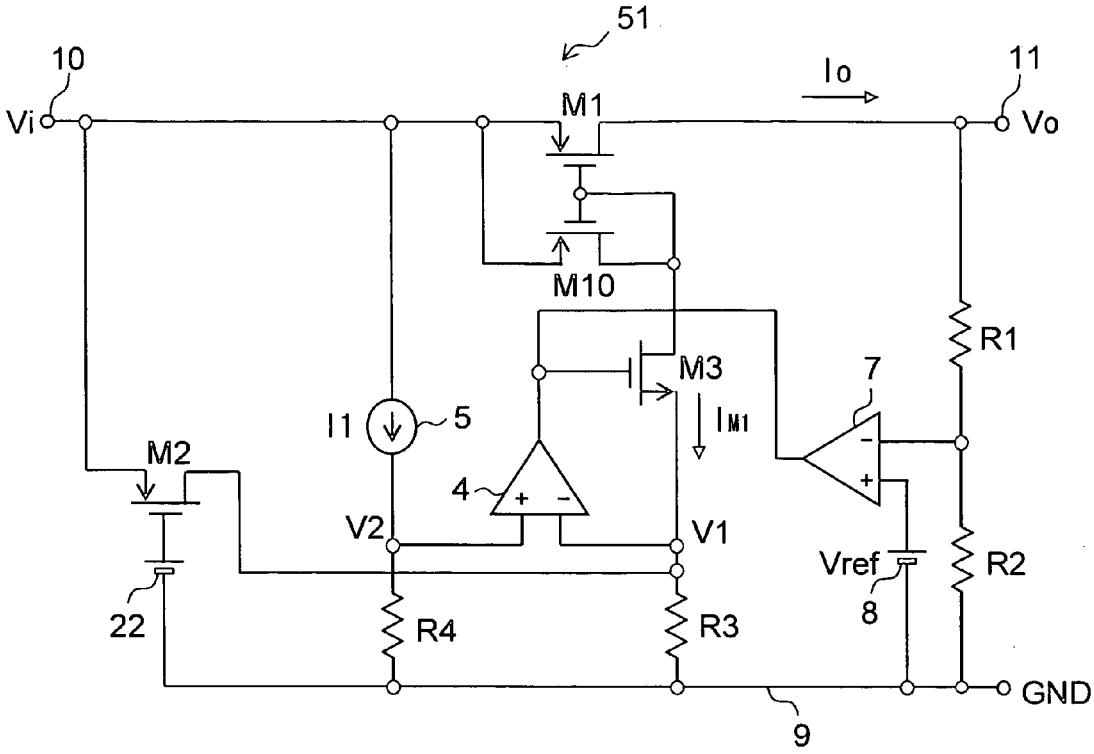
FIG. 17 is a circuit diagram of a stabilized DC power supply circuit according to a seventh embodiment of the present invention.

The following will describe a stabilized DC power supply circuit 51 (hereinafter, referred to as "power supply circuit 51" simply) that uses a field effect transistor and that corresponds to the first embodiment, as the seventh embodiment. FIG. 17 is a circuit diagram of the power supply circuit 51. In FIG. 17, the same components as those of FIG. 1 etc. are indicated by the same reference numerals, to omit duplicated description of the same components in principle.

The power supply circuit 51 includes an output transistor M1, a transistor M10, a driving transistor M3, "an output current limiting circuit constituted of a differential amplifier 4, a constant current source 5, and resistors R3 and R4", "a correction circuit constituted of a correcting transistor M2 and a constant voltage source 22", voltage dividing resistors R1 and R2, an error amplifier 7, and a reference voltage source 8.

The output transistor M1, the correcting transistor M2, and the transistor M10 are each a P-channel type MOSFET and the driving transistor M3 is an N-channel type MOSFET.

An input terminal 10 is supplied with an input voltage Vi (e.g., 12 VDC), which is a voltage-to-be-stabilized from an outside. The input terminal 10 is commonly connected to a source of the correcting transistor M2, a source of the output transistor M1, a source of the transistor M10, and an input side of the constant current source 5.

A drain of the output transistor M1 is connected to an output terminal 11 to which an output voltage Vo of the power supply circuit 51 is to be output and also to a ground line 9 held to 0-V potential (GND) via a series circuit including the voltage dividing resistors R1 and R2. In the error amplifier 7, its inverting input terminal (−) is supplied with a potential of a node between the voltage dividing resistors R1 and R2 and its non-inverting input terminal (+) is supplied with a reference potential Vref output by the reference voltage source 8.

An output side of the constant current source 5 is connected via the resistor R4 to the ground line 9 and also to a non-inverting input terminal (+) of the differential amplifier 4. A constant current (whose magnitude is indicated by I1) output by the constant current source 5 flows through the resistor R4 into the ground line 9. An inverting input terminal (−) of the differential amplifier 4, on the other hand, is connected to a node between a source of the driving transistor M3 and the resistor R3 and also to a drain of the correcting transistor M2.

A gate of the correcting transistor M2 is supplied with a constant voltage from the constant voltage source 22. A gate of the driving transistor M3 is connected to commonly connected output terminals of the differential amplifier 4 and the error amplifier 7. A gate of the output transistor M1 and that of the transistor M10 are connected to each other and the gate and a drain of the transistor M10 are short-circuited. The drain of the transistor M10 is connected to a drain of the driving transistor M3.

Like a relationship between the output transistor Q1 and the correcting transistor Q2, the output transistor M1 and the correcting transistor M2 are formed in the same manufacturing process and so that manufacturing process variation-dependency and temperature-dependency (characteristics of changes in mutual conductance with respect to changes in temperature during operation) of mutual conductance (relationship between a gate-source voltage and a drain current) of each of these transistors may have the same tendency.

That is, the output transistor M1 and the correcting transistor M2 are formed so that mutual conductance gm1 of the output transistor M1 and mutual conductance gm2 of the correcting transistor M2 may vary in the same direction by the same degree owing to variation of the manufacturing processes and they may change in the same direction by the same degree owing to the same change in temperature (change in temperature of the power supply circuit during operations). It is to be noted that the temperature herein means an ambient temperature of the output transistor M1 and the correcting transistor M2 and can be thought of as an ambient temperature of the power supply circuit 51.

The above-described phenomenon that "manufacturing process variation-dependency and temperature-dependency of mutual conductance values gm1 and gm2 have the same tendency" is hereinafter referred to as "characteristics similarity β" for convenience in explanation. That is, for example, such expression is used that the output transistor M1 and the correcting transistor M2 are formed so as to have the characteristics similarity β or that the correcting transistor M2 has the characteristics similarity β in relation to the output transistor M1.

For the output transistor M1 and the correcting transistor M2 to have the characteristics similarity β, desirably, they have the same shape. The shape herein means a semiconductor shape in which an MOSFET is formed, for example. That is, in comparison between the output transistor M1 and the correcting transistor M2, desirably, shapes of semiconductor regions in which the source, the drain, and the gate are formed are the same respectively and these semiconductor regions have the same positional relationship (same cross-sectional structure).

Further, in comparison between the output transistor M1 and the correcting transistor M2, not only the semiconductor shapes in which the MOSFETs are formed but also shapes of electrodes connected to the semiconductor regions may be the same. That is, the shapes of the output transistor M1 and the correcting transistor M2 may be the same, including a positional relationship and a magnitude relationship between a drain forming semiconductor region and a drain electrode connected thereto, those between a source forming semiconductor region and a source electrode connected thereto, and those between a gate forming semiconductor region and a gate electrode connected thereto.

Further, for the output transistor M1 and the correcting transistor M2 to have the characteristics similarity β, desirably, they have the same sizes (magnitudes) of the above-described shapes. However, since the correcting transistor M2 may only need to have a relatively small output current capacity, it may be possible to form the correcting transistor M2 smaller than the output transistor M1 depending on a required output current capacity while keeping the sameness in shape between them.

Although desirably the output transistor M1 and the correcting transistor M2 have the same shape and the same size as described above, these shape and size each need not be all the same as far as these transistors have the characteristics similarity β. For example, if the output transistor M1 and the correcting transistor M2 are to be formed on a semiconductor substrate, drain regions in which they are to be formed need not have completely the same width (width in a direction of a surface of the substrate) and source regions in which they are to be formed need not have completely the same width (width in a direction of a surface of the substrate). For the mutual conductance does not depend on the width of these drain regions and source regions.

In the power supply circuit 51 thus configured, the error amplifier 7 controls the output current Io by controlling a gate potential of the driving transistor M3 so that a potential of the node between the voltage dividing resistors R1 and R2 may be equal to the reference potential Vref In such a manner, the output voltage Vo is stabilized to a predetermined voltage value.

Since the output transistor M1 and the transistor M10 form a current mirror circuit, a magnitude of a drain current of the output transistor M1, that is, a magnitude of the output current Io of the power supply circuit 51 is proportional to a magnitude of a drain current of the transistor M10. Herein, the drain current of the transistor M10 is referred to as a detecting current $I_{M1}$. The detecting current $I_{M1}$ flows into the ground line 9 via the driving transistor M3 and the resistor R3.

The differential amplifier 4 compares to each other a detection potential V1, which is a potential of the inverting input terminal (−), and a reference voltage V2, which is a potential of the non-inverting input terminal (+), and, if the detection potential V1 exceeds the reference potential V2, lowers an output potential of the error amplifier 7, that is, the gate potential of the driving transistor M3. In such a manner, an increase in output current Io is limited.

For example, if the mutual conductance gm1 of the output transistor M1 becomes relatively large owing to variation of the manufacturing processes, a gate-source voltage of the output transistor M1 becomes relatively small with respect to the same output current Io, thereby making the detecting current $I_{M1}$ relatively small. However, in this case, the mutual conductance gm2 of the correcting transistor M2 also becomes large, so that a relatively large drain current of the correcting transistor M2 flows into the resistor R3 as a correcting current. Accordingly, the smallness of the detecting current $I_{M1}$ is offset, to provide the same effects as those of the first embodiment.

It is to be noted that, of course, the mutual conductance gm1 represents relationship between a physical quantity of a voltage (voltage with respect to a source electrode) of the gate electrode (control electrode) of the output transistor M1 and a quantity of a drain current (magnitude of the output current Io) of the output transistor M1. Further, the detecting current $I_{M1}$ reflects the drain current (that is, the output current Io) of the output transistor M1 and the mutual conductance gm1 as may be clear from the above description.

Eighth Embodiment

Figure 18:
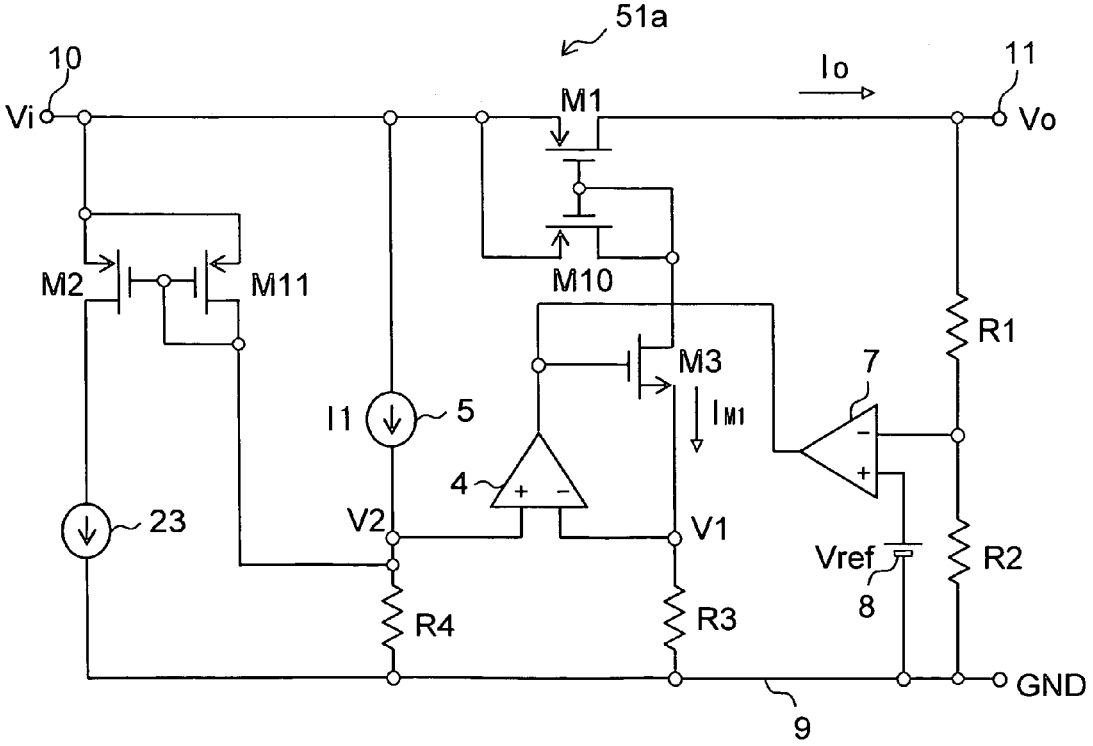
FIG. 18 is a circuit diagram of a stabilized DC power supply circuit according to an eighth embodiment of the present invention.

The following will describe a stabilized DC power supply circuit 51*a* (hereinafter, referred to as "power supply circuit 51a" simply) that uses a field effect transistor and that corresponds to the second embodiment, as the eighth embodiment. FIG. 18 is a circuit diagram of the stabilized DC power supply circuit 51*a*. In FIG. 18, the same components as those of FIGS. 2, 17, etc. are indicated by the same reference numerals, to omit duplicated description of the same components in principle.

The power supply circuit 51*a* has the same circuit configuration and operations as the power supply circuit 51 of FIG. 17 except that the correction circuit constituted of the correcting transistor M2 and the constant voltage source 22 in the power supply circuit 51 of FIG. 17 is replaced with a correction circuit constituted of a correcting transistor M2 and a transistor M11 and a constant current source 23. The following will describe only the correction circuit in the power supply circuit 51*a* different from that in the power supply circuit 51.

The transistor M11 is a P-channel type MOSFET. In the power supply circuit 51*a*, sources of the correcting transistor M2 and the transistor M11 are both connected to an input terminal 10. A drain of the correcting transistor M2 is connected to an input side the constant current source 23, so that a drain current of the correcting transistor M2 is constant. A gate and a drain of the transistor M11 are short-circuited and connected to a non-inverting input terminal (+) of a differential amplifier 4. The correcting transistor M2 and the transistor M11, whose gates are connected to each other, form a current mirror circuit.

For example, if mutual conductance gm1 of the output transistor M1 becomes relatively large due to variation of the manufacturing processes etc., a gate-source voltage of the output transistor M1 becomes relatively small with respect to the same output current Io, thereby making a detecting current $I_{M1}$ relatively small. However, in this case, mutual conductance gm2 of the correcting transistor M2 also becomes large, and moreover, since the drain current of the correcting transistor M2 is constant, a gate-source voltage of the correcting transistor M2 becomes relatively small. Accordingly, a relatively small drain current of the transistor M11 flows through a resistor R4, thereby reducing variation in output peak current that is caused by a relatively small magnitude of the detecting current $I_{M1}$.

Figure 19:
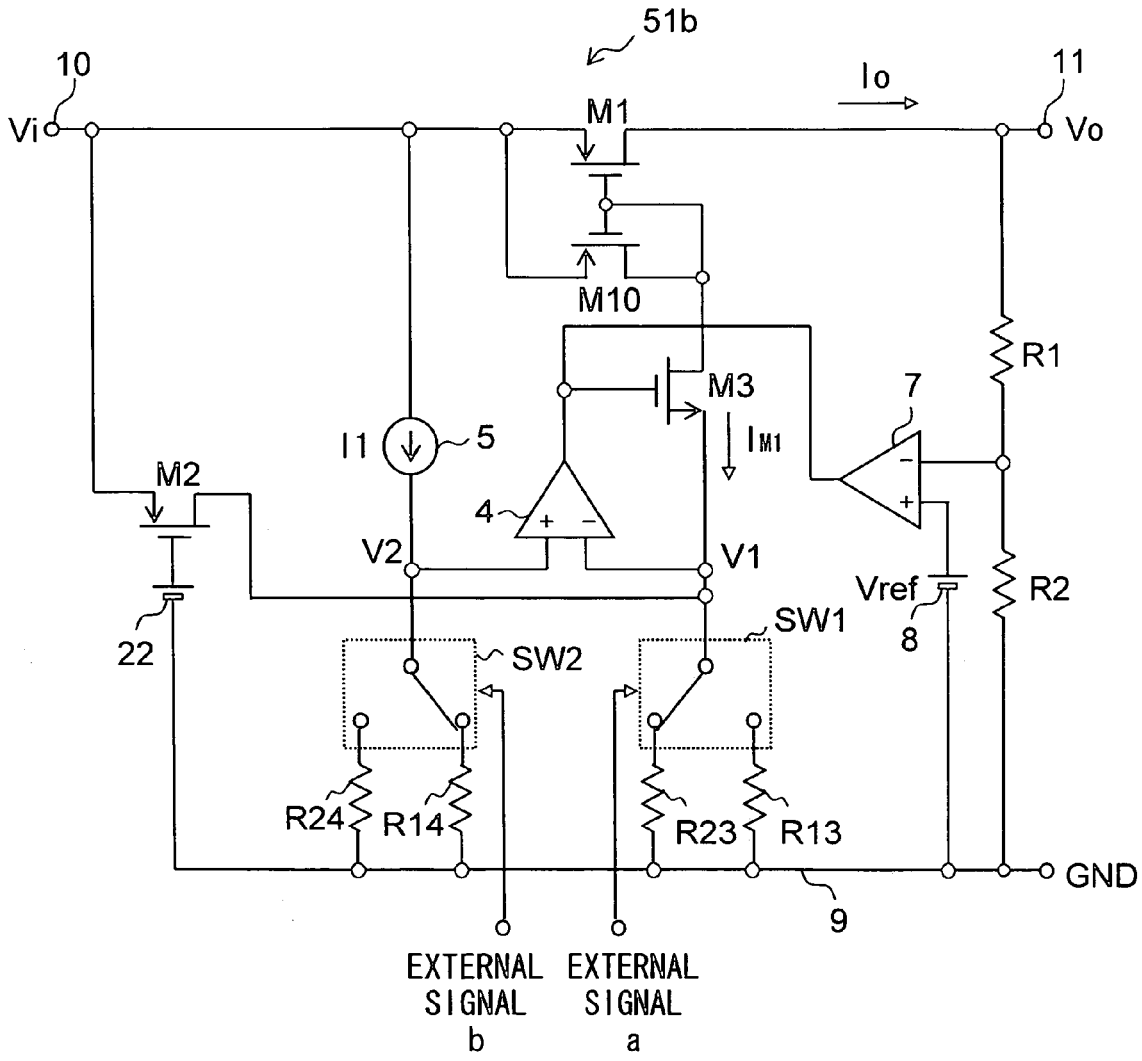
FIG. 19 is a circuit diagram showing a modification of the stabilized DC power supply circuit of FIG. 17.

Further, as described with the second embodiment, the resistors R3 and R4 may be formed as a variable resistor whose resistance value can be changed in accordance with an external signal etc. FIG. 19 shows a circuit diagram of a stabilized DC power supply circuit 51*b* in which the resistors R3 and R4 in the power supply circuit 51 of FIG. 17 have been modified into a variable resistor. In FIG. 19, the same components as those of FIGS. 3 and 17 are indicated by the same reference numerals, to omit duplicated description of the same components.

Ninth Embodiment

Figure 20:
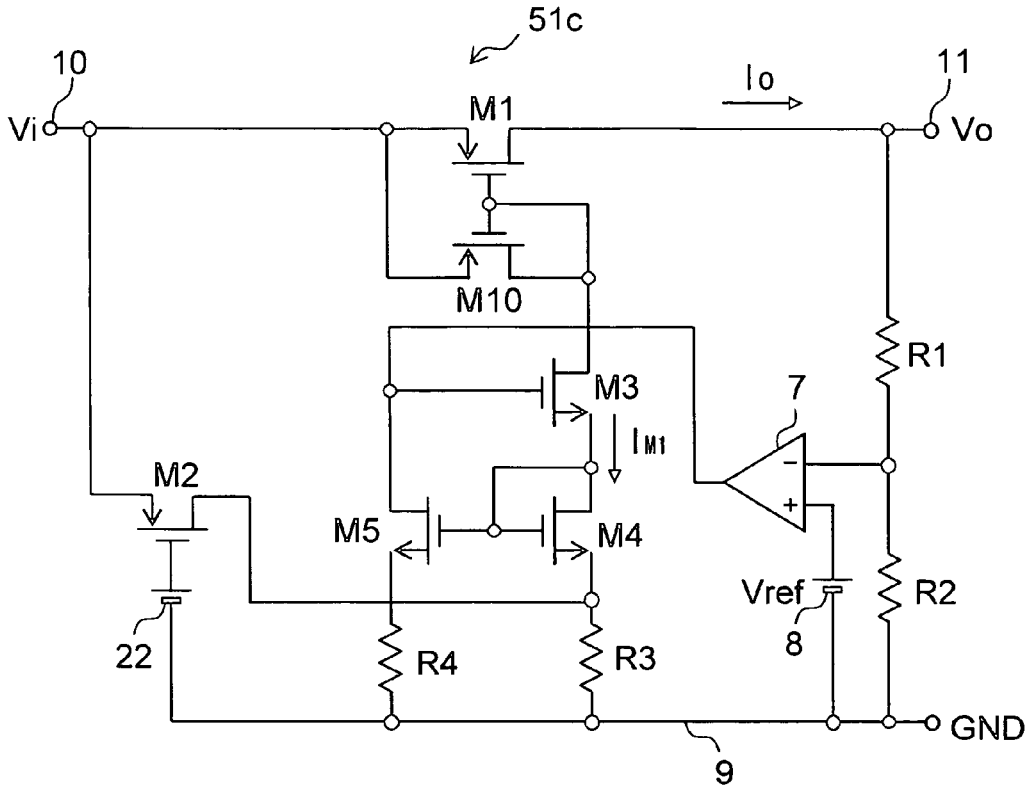
FIG. 20 is a circuit diagram of a stabilized DC power supply circuit according to a ninth embodiment of the present invention.

The following will describe a stabilized DC power supply circuit 51*c* (hereinafter, referred to as "power supply circuit 51c" simply) that uses a field effect transistor and that corresponds to the third embodiment, as the ninth embodiment. FIG. 20 is a circuit diagram of the power supply circuit 51*c*. In FIG. 20, the same components as those of FIG. 17 etc. are indicated by the same reference numerals, to omit duplicated description of the same components in principle.

The power supply circuit 51*c* includes an output transistor M1, a transistor M10, a driving transistor M3, "an output current limiting circuit constituted of a transistor M5, and resistors R3 and R4", "a correction circuit constituted of a correcting transistor M2 and a constant voltage source 22", a transistor M4, voltage dividing resistors R1 and R2, an error amplifier 7, and a reference voltage source 8. The transistor M4 can be thought of as a component of the output current limiting circuit and also as a component of the correction circuit. The transistors M4 and M5 are each an N-channel type MOSFET. As described above, the output transistor M1 and the correcting transistor M2 are formed to have a characteristics similarity β.

"Connection relationships between components of an input terminal 10, an output terminal 11, the output transistor M1, the transistor M10, the driving transistor M3, the resistors R1 and R2, the error amplifier 7, and the reference voltage source 8" in the power supply circuit 51*c* are the same as those in the power supply circuit 51 of FIG. 17, so that description of these connection relationships between the components is omitted (in principle).

A drain of the output transistor M4 is connected to a source of the driving transistor M3 and also short-circuited to a gate of its own transistor. Gates of the transistors M4 and M5 are connected to each other and sources of these transistors M4 and M5 are connected to a ground line 9 via the resistors R3 and R4, respectively. A drain of the transistor M5 is connected to a gate of the driving transistor M3 and also to an output terminal of the error amplifier 7.

The transistors M4 and M5 constitute a current mirror circuit (detecting current mirror circuit) for outputting, as a drain current of the transistor M5, a current obtained by proportionally multiplying a drain current of the transistor M4, which is a current on the input side of the current mirror circuit, that is, a detecting current $I_{M1}$.

A gate of the correcting transistor M2 is supplied with a constant voltage from the constant voltage source 22 and a source of this correcting transistor M2 is connected to the input terminal 10 and its drain is connected to a node between the transistor M4 and the resistor R3. Therefore, a drain current from the correcting transistor M2 functions as a correcting current from the correction circuit, thereby providing the same effects as those of the power supply circuit 51 of FIG. 17 (seventh embodiment). Further, the power supply circuit 51*c* need not use the constant current source 5 shown in FIG. 17 and, therefore, has its circuitry simplified.

Tenth Embodiment

Figure 21:
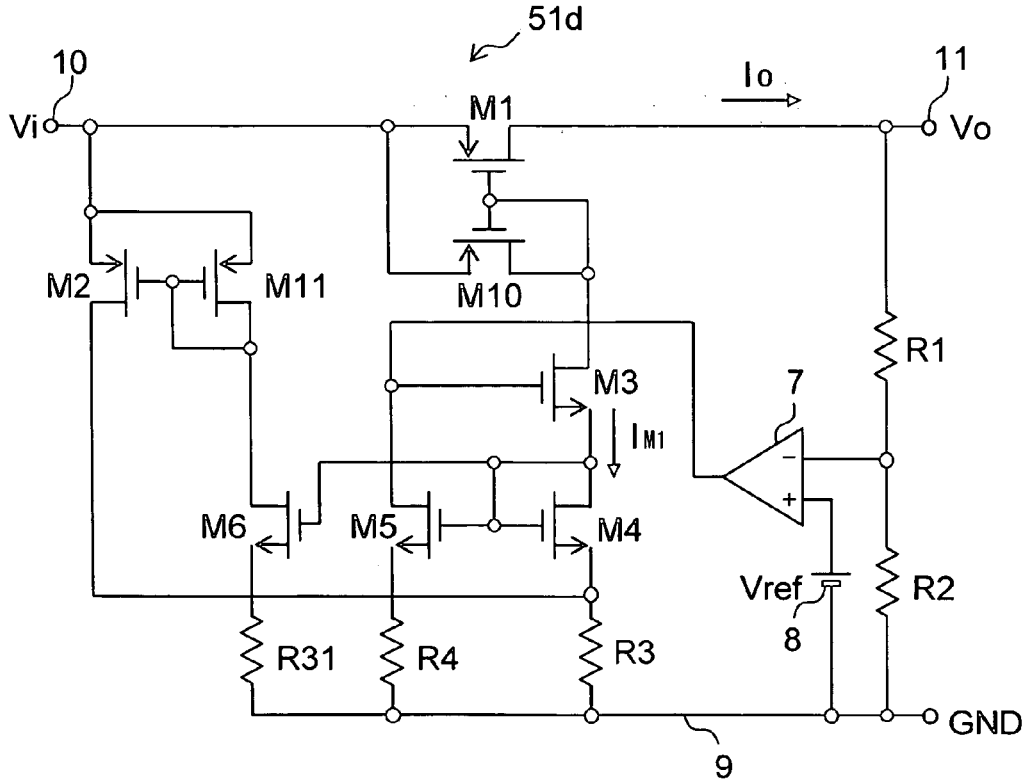
FIG. 21 is a circuit diagram of a stabilized DC power supply circuit according to a tenth embodiment of the present invention.

The following will describe a stabilized DC power supply circuit 51*d* (hereinafter, referred to as "power supply circuit 51d" simply) that uses a field effect transistor and that corresponds to the fourth embodiment, as the tenth embodiment. FIG. 21 is a circuit diagram of the power supply circuit 51*d*. In FIG. 21, the same components as those of FIG. 20 etc. are indicated by the same reference numerals, to omit duplicated description of the same components in principle.

The power supply circuit 51*d* includes an output transistor M1, a transistor M10, a driving transistor M3, "an output current limiting circuit constituted of a transistor M5, and resistors R3 and R4", "a correction circuit constituted of a correcting transistor M2, a resistor R31, and transistors M6 and M1", a transistor M4, voltage division resistors R1 and R2, an error amplifier 7, and a reference voltage source 8. The transistor M4 can be thought of as a component of the output current limiting circuit and also as a component of the correction circuit. The transistors M4, M5, and M6 are each an N-channel type MOSFET and the transistor M11 is a P-channel type MOSFET.

"Connection relationships between components of an input terminal 10, an output terminal 11, the output transistor M1, the transistor M10, the driving transistor M3, the resistors R1 and R2, the error amplifier 7, the reference voltage source 8, the transistors M4 and M5, and the resistors R3 and R4" in the power supply circuit 51*d* are the same as those in the power supply circuit 51*c* of FIG. 20, so that description of these connection relationships between the components is omitted (in principle).

In the power supply circuit 51*d*, sources of the correcting transistor M2 and the transistor M11 are both connected to the input terminal 10. A gate and a drain of the transistor M11 are short-circuited and connected to a drain of the transistor M6. The correcting transistor M2 and the transistor M11, whose gates are connected to each other, form a current mirror circuit.

Gates of the transistors M4, M5, and M6 are connected to each other, a source of which transistor M6 is connected to a ground line 9 via the resistor R31. The transistors M4 and M6 constitute a current mirror circuit (correcting current mirror circuit) for outputting, as a drain current of the transistor M6, a current obtained by proportionally multiplying a drain current of the transistor M4, which is a current on the input side of the current mirror circuit, that is, a detecting current $I_{M1}$. An output current of this current mirror circuit (drain current of the transistor M6) provides a drain current of the transistor M11, so that the gate of the correcting transistor M2 is supplied with a voltage that corresponds to an output current of the current mirror circuit (correcting current mirror circuit) constituted of the transistors M4 and M6.

A drain of the correcting transistor M2 is connected to a node between a source of the transistor M4 and the resistor R3, so that a drain current of the correcting transistor M2 that corresponds to the above-described voltage (gate voltage) flows into the resistor R3 as a correcting current. Therefore, when limiting an output current Io, the power supply circuit 51*d* operates the same way as the power supply circuit 1*d* of FIG. 10, thereby providing the same effects as the fourth embodiment.

Eleventh Embodiment

Figure 22:
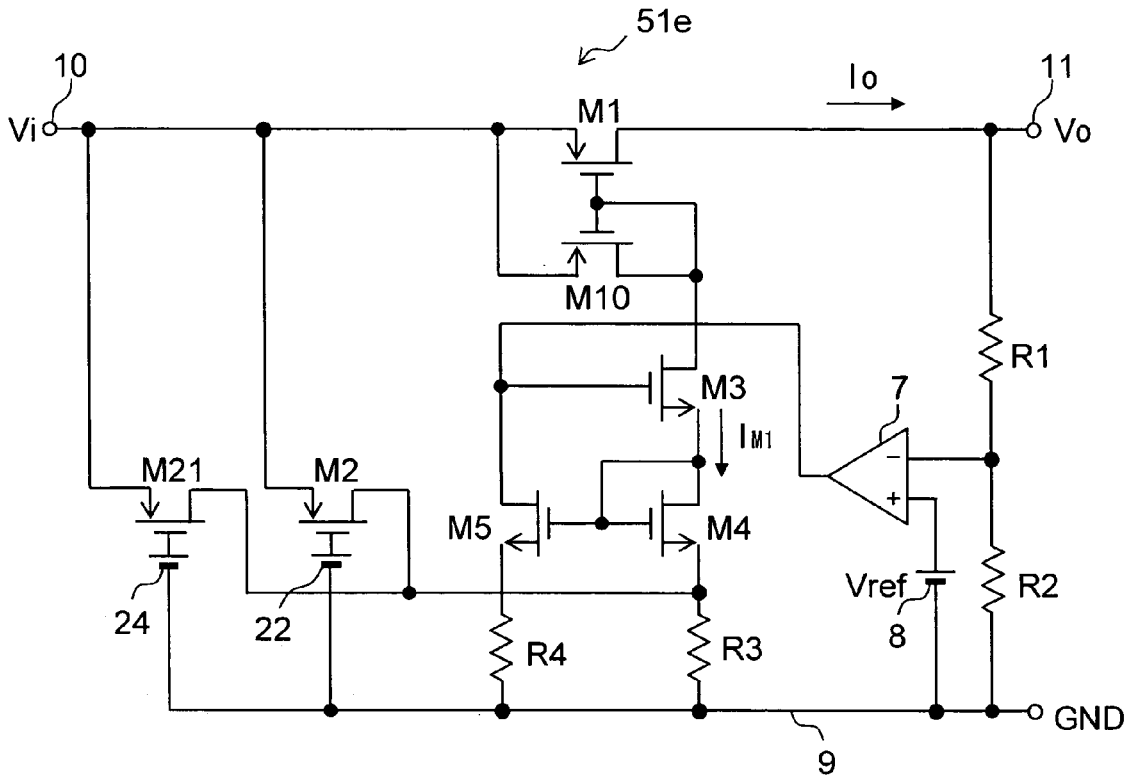
FIG. 22 is a circuit diagram of a stabilized DC power supply circuit according to an eleventh embodiment of the present invention.

The following will describe a stabilized DC power supply circuit 51*e* (hereinafter, referred to as "power supply circuit 51e" simply) that uses a field effect transistor and that corresponds to the fifth embodiment, as the eleventh embodiment. FIG. 22 is a circuit diagram of the power supply circuit 51*e*. In FIG. 22, the same components as those of FIG. 20 etc. are indicated by the same reference numerals, to omit duplicated description of the same components in principle.

The power supply circuit 51*e* has the same circuit configuration and operations as those of the power supply circuit 51*c* of FIG. 20 except that the correction circuit constituted of the correcting transistor M2 and the constant voltage source 22 in FIG. 20 is replaced with a correction circuit constituted of correcting transistors M2 and M21 and constant voltage sources 22 and 24, so that description about the same points is omitted.

The correcting transistor M21 is identical to the correcting transistor M2 and is formed so as to have the characteristics similarity β in relation to the output transistor M1.

Sources of the correcting transistors M2 and M21 are both connected to an input terminal 10 and also to a source of an output transistor M1, and drains of the correcting transistors M2 and M21 are both connected to a node between a source of a transistor M4 and a resistor R3. Gates of the correcting transistors M2 and M21 are supplied with constant voltages from constant voltage sources 22 and 24, respectively. These constant voltages from the constant voltage sources 22 and 24 may be the same with each other or different from each other.

By providing a plurality of correcting transistors as in the case of the power supply circuit 51*e* of FIG. 22, a plurality of corrections can be conducted on variation in mutual conductance gm1 of the output transistor M1, so that variation in output peak current can be reduced more with respect to variation in the mutual conductance gm1.

Twelfth Embodiment

Figure 23:
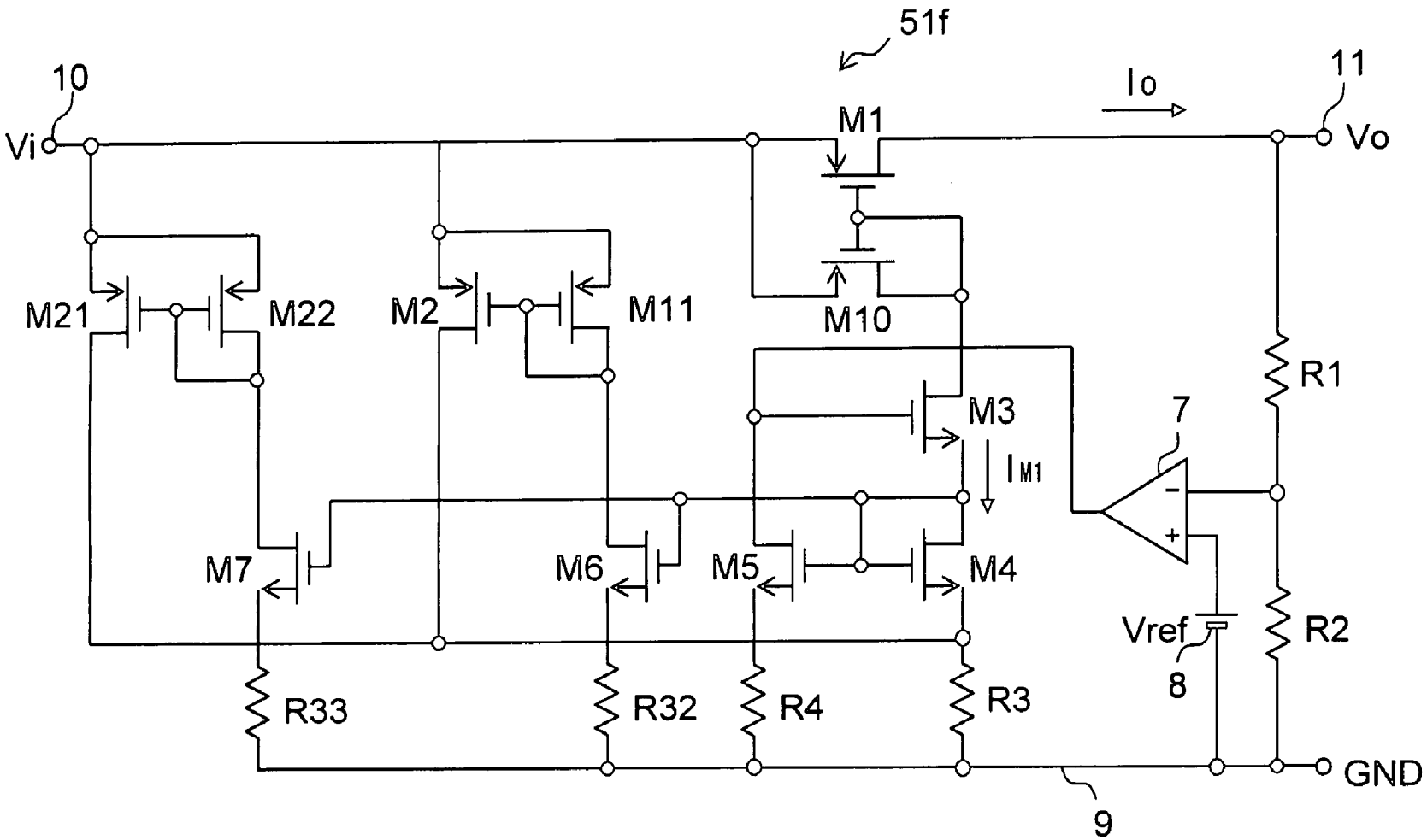
FIG. 23 is a circuit diagram of a stabilized DC power supply circuit according to a twelfth embodiment of the present invention.

The following will describe a stabilized DC power supply circuit 51*f* (hereinafter, referred to as "power supply circuit 51f" simply) that uses a field effect transistor and that corresponds to the sixth embodiment, as the twelfth embodiment. FIG. 23 is a circuit diagram of the power supply circuit 51*f* In FIG. 23, the same components as those of FIGS. 21, 22, etc. are indicated by the same reference numerals, to omit duplicated description of the same components in principle.

The power supply circuit 51*f* has the same circuit configuration and operations as those of the power supply circuit 51*d* of FIG. 21 except that "the correction circuit constituted of the correcting transistor M2, the resistor R31, and the transistors M6 and M11" of FIG. 21 is replaced with "a correction circuit constituted of a correcting transistor M2, a resistor R32, transistors M6 and M11, a correcting transistor M21, a resistor R33, and transistors M7 and M22", so that description about the same points is omitted.

The correcting transistor M21 is identical to the correcting transistor M2 and is formed so as to have the characteristics similarity β in relation to the output transistor M1. The transistors M6 and M7 are each an N-channel type MOSFET and the transistors M11 and M22 are each a P-channel type MOSFET.

Sources of the correcting transistors M2 and M21 and sources of the transistors M11 and M22 are all connected commonly to an input terminal 10 and also to a source of the output transistor M1, and drains of the correcting transistors M2 and M21 are both connected to a node between a source of the transistor M4 and the resistor R3. A gate and a drain of each of the transistors M11 and M22 are short-circuited to each other and drains of these transistors M11 and M22 are connected to drains of the transistors M6 and M7, respectively.

Gates of the correcting transistor M2 and the transistor M11 are connected to each other and the gates of the correcting transistor M21 and the transistor M22 are connected to each other. Gates of the transistors M4, M5, M6, and M7 are all connected to each other and sources of the transistors M6 and M7 are connected to a ground line 9 via the resistors R32 and R33, respectively.

By thus configuring the power supply circuit 51*f*, it is possible to obtain the same effects as those of the fifth or sixth embodiment.

Further, also by providing a plurality of elements to bear functions of the transistor M5, a breadth of a value that the output current Io may take on in a period from a moment when the output current limiting circuit starts to operate to a moment when an output voltage Vo is reduced to zero can be narrowed. That is, in FIG. 20 etc., the breadth can be reduced also by providing, separately from the transistor M5, at least one MOSFET (not shown) whose gate is connected to the gate of the transistor M4, whose drain is connected to the gate of the driving transistor M3, and whose source is connected via a resistor (not shown) to the ground line 9.

Figure 24:
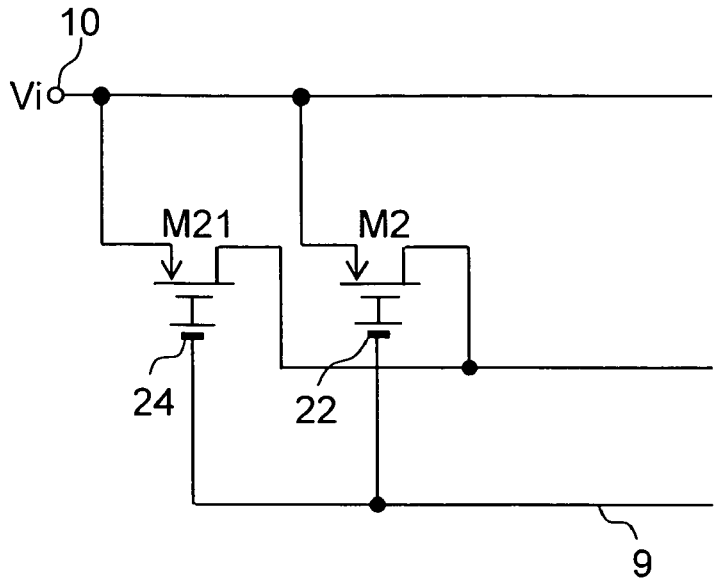
FIG. 24 is a circuit diagram showing a modification of part of a circuit of FIG. 17.

Further, in the seventh embodiment also, a plurality of correcting transistors may be provided. That is, for example, in the power supply circuit 51 of FIG. 17, as shown in FIG. 24, a correcting transistor M21 whose source and drain are connected to a source and a drain of the correcting transistor M2 respectively is provided separately, to connect a constant voltage source 24 to a gate of the correcting transistor M21 so that a gate voltage of the correcting transistor M21 may be constant. In this case, the drains of the correcting transistors M2 and M21 are connected to the inverting input terminal (−) of the differential amplifier 4 of FIG. 17. It is to be noted that in FIG. 24, values of the constant voltages to be applied to the gates of the correcting transistors M2 and M21 may be the same or different from each other.

Figure 25:
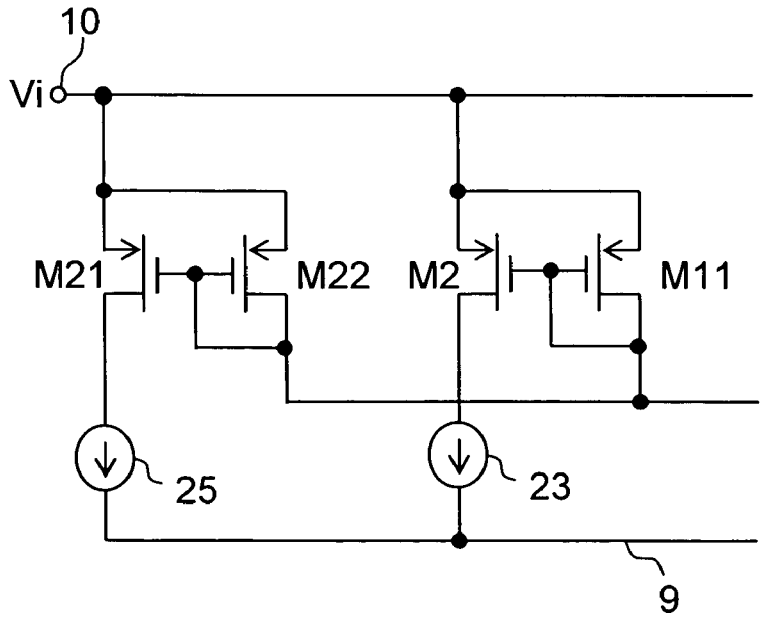
FIG. 25 is a circuit diagram showing a modification of part of a circuit of FIG. 18.

Similarly, in the eighth embodiment also, a plurality of correcting transistors may be provided. That is, for example, in the power supply circuit 51*a* of FIG. 18, as shown in FIG. 25, a correcting transistor M21 and a transistor M22 whose sources are each connected to a source of the correcting transistor M2 are provided separately, to connect a constant current source 25 to a drain of the correcting transistor M21 so that a drain current of the correcting transistor M21 may be constant. In FIG. 25, gates of the correcting transistor M21 and the transistor M22 are connected to each other and a drain of the transistor M22 is connected to the gate of its own transistor and also to the drain of the transistor M11. In this case, the drains of the transistors M11 and M22 are connected to the non-inverting input terminal (+) of the differential amplifier 4 of FIG. 18. It is to be noted that in FIG. 25, magnitudes of the constant currents to flow to the drains of the correcting transistors M2 and M21 may be the same or different from each other.

In the seventh and eighth embodiments, by providing a plurality of correcting transistors, a plurality of corrections can be conducted on variation in mutual conductance gm1 of the output transistor M1, so that variation in output peak current can be reduced more with respect to variation in mutual conductance gm1. It is to be noted that in FIGS. 24 and 25, the same components as those of the other figures are indicated by the same reference numerals.

Thirteenth Embodiment

Although in the seventh to twelfth embodiments a detecting current $I_{M1}$ reflecting an output current Io and mutual conductance gm1 of an output transistor M1 has been utilized in restriction of the output current Io, instead a potential may be utilized which reflects the output current Io and the mutual conductance gm1 of the output transistor M1. For example, by correcting this potential by using a physical quantity that reflects mutual conductance gm2 of a correcting transistor M2 to limit the output current Io by using the corrected potential, the same effects as those of these embodiments can be obtained.

Figure 26:
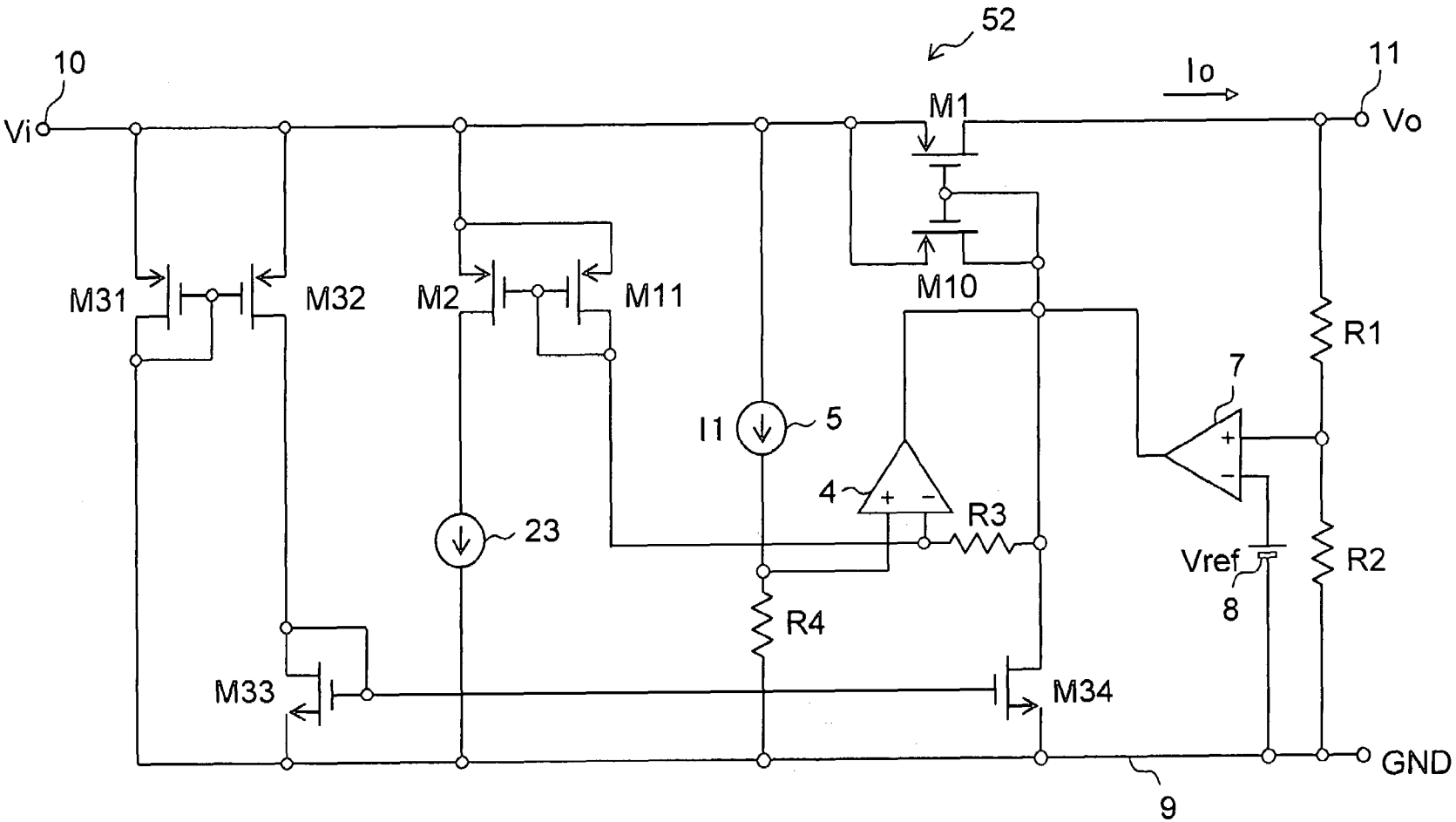
FIG. 26 is a circuit diagram of a stabilized DC power supply circuit according to a thirteenth embodiment of the present invention.

In the case of limiting the output current Io by utilizing such a potential in place of the detecting current $I_{M1}$, circuit configurations of the above-described embodiments are changed appropriately. The following will describe the thirteenth embodiment as one example of a stabilized DC power supply circuit thus changed. FIG. 26 is a circuit diagram of a stabilized DC power supply circuit 52 (hereinafter, referred to as "power supply circuit 52" simply) according to the thirteenth embodiment. In FIG. 26, the same components as those of FIGS. 1, 18, etc. are indicated by the same reference numerals, to omit duplicated description of the same components in principle.

The power supply circuit 52 includes the output transistor M1, a transistor M10, "an output current limiting circuit constituted of a differential amplifier 4, a constant current source 5, and resistors R3 and R4", "a correction circuit constituted of the correcting transistor M2, a transistor M11, and a constant current source 23", voltage dividing resistors R1 and R2, an error amplifier 7, a reference voltage source 8, and transistors M31, M32, M33, and M34. It is to be noted that the transistors M31 to M34 can be thought of as components of the output current limiting circuit.

The transistor M31 and M32 are each a P-channel type MOSFET and the transistors M33 and M34 are each an N-channel type MOSFET.

An input terminal 10 is supplied with an input voltage Vi (e.g., 12 VDC), which is a voltage-to-be-stabilized from an outside. The input terminal 10 is commonly connected to a source of the output transistor M1, a source of the correcting transistor M2, sources of the transistors M10, M11, M31, and M32, and an input side of a constant current source 5.

A drain of the output transistor M1 is connected to an output terminal 11 to which an output voltage Vo of the power supply circuit 52 is to be provided and also to a ground line 9 held to a 0-V potential (GND) via a series circuit constituted of the voltage dividing resistors R1 and R2. A non-inverting input terminal (+) of the error amplifier 7 is supplied with a potential of a node between the voltage dividing resistors R1 and R2 and an inverting input terminal (−) thereof is supplied with a reference potential Vref output by the reference voltage source 8.

An output side of the constant current source 5 is connected to the ground line 9 via the resistor R4 and also to the non-inverting input terminal (+) of the differential amplifier 4. A constant current (whose magnitude is indicated by I1) output by the constant current source 5 flows into the ground line 9 via a resistor R4. Further, the inverting input terminal (−) of the differential amplifier 4 is commonly connected to a drain of the transistor M11 and one end of the resistor R3. The other end of the resistor R3 is commonly connected to a gate of the output transistor M1, a gate of the transistor M10, an output terminal of the differential amplifier 4, an output terminal of the error amplifier 7, and a drain of the transistor M34. Further, the gate and the drain of the transistor M10 are short-circuited.

A drain and a gate of the transistor M11 are short-circuited and gates of the correcting transistor M2 and the transistor M11 are connected to each other. A drain of the correcting transistor M2 is connected via the constant current source 23 to the ground line 9, so that a drain current of the correcting transistor M2 is constant.

Gates of the transistors M31 and M32 are connected to each other and the gate and a drain of the transistor M31 are short-circuited. The drain of the transistor M31 is connected to the ground line 9.

The gate and a drain of the transistor M33 are short-circuited and its source is connected to the ground line 9. The drain of the transistor M33 is connected to a drain of the transistor M32. The gates of the transistors M33 and M34 are connected to each other and a source of the transistor M34 is connected to the ground line 9.

The transistors M31 and M32 form a current mirror circuit that has the transistor M31 on its current input side, while the transistors M33 and M34 form a current mirror circuit that has the transistor M33 on its current input side.

In the power supply circuit 52 thus configured, the error amplifier 7 controls the output current Io by controlling a gate potential of the output transistor M1 so that a potential of the node between the voltage dividing resistors R1 and R2 may be equal to the reference potential Vref In such a manner, the output voltage Vo is stabilized to a predetermined voltage value.

The differential amplifier 4 compares a potential of the inverting input terminal (−) with that of the non-inverting input terminal (+). If the potential of the inverting input terminal (−) becomes less than the potential of the non-inverting input terminal (+) as a gate potential of the output transistor M1 decreases with the increasing output current Io, the differential amplifier 4 increases an output potential of the error amplifier 7, that is, the gate potential of the output transistor M1. In such a manner, an increase in output current Io is restricted.

In the power supply circuit 52, the gate potential of the output transistor M1 functions as a reflection potential that reflects the output current To and mutual conductance gm1 of the output transistor M1.

For example, if the mutual conductance gm1 of the output transistor M1 has become relatively large due to variation of manufacturing processes etc., a gate-source voltage of the output transistor M1 with respect to the same output current Io becomes relatively small, to make the gate potential of the output transistor M1 relatively high (that is, the output current Io becomes to be less restricted).

However, in this case, mutual conductance gm2 of the correcting transistor M2 formed so as to have a characteristics similarity β in relation to the output transistor M1 also becomes relatively large, so that a gate-source voltage of the correcting transistor M2 also becomes relatively small. As a result, a relatively small drain current of the correcting transistor M11 flows into the resistor R3, thereby making a voltage drop across the resistor R3 relatively small.

That is, if attention is paid to a potential of the inverting input terminal (−) of the differential amplifier 4, an increase in gate potential of the output transistor M1 in a case where the mutual conductance gm1 has become relatively large is offset by a decrease in voltage drop across the resistor R3. Accordingly, also by configuring a power supply circuit according to the present embodiment, the same effects as those of the other embodiments can be obtained.

It is to be noted that, of course, a drain current (correcting current) of the transistor M11 that flows into the resistor R3 is a physical quantity that reflects the mutual conductance gm2 of the correcting transistor M2. Further, a potential of the inverting input terminal (−) of the differential amplifier 4 can be thought of a potential obtained by correcting the gate potential (reflection potential) of the output transistor M1 by using this physical quantity.

Figure 27:
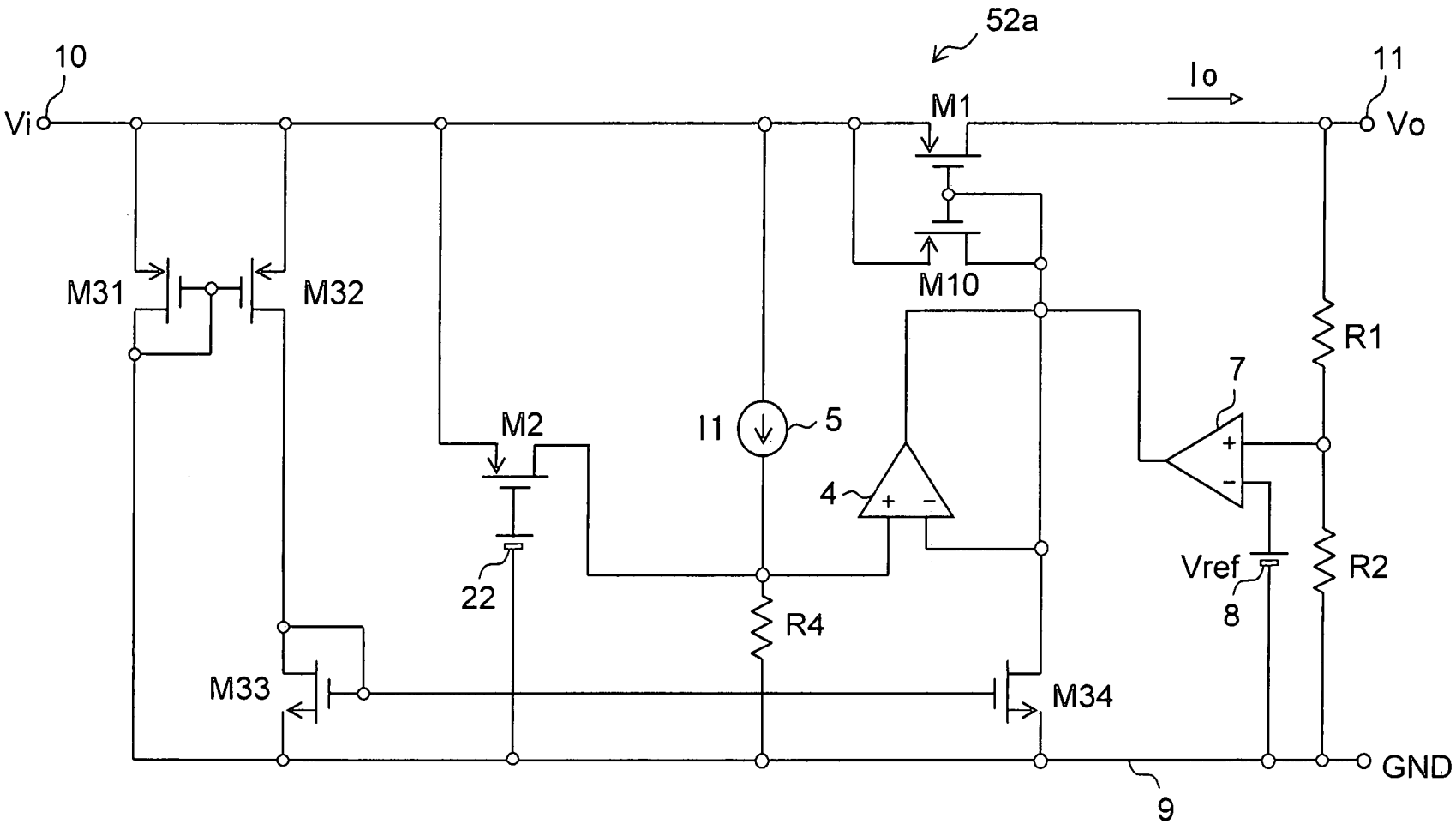
FIG. 27 is a circuit diagram showing a modification of the stabilized DC power supply circuit of FIG. 26.

Further, "the correction circuit constituted of the correcting transistor M2, the transistor M11, and the constant current source 23" in the power supply circuit 52 may be replaced with "a correction circuit constituted of a correcting transistor M2 and a constant voltage source 22". A circuit diagram of a stabilized DC power supply circuit 52*a* (hereinafter, referred to as "power supply circuit 52a" simply) as a modified circuit of such a replacement is shown in FIG. 27. As involved in this replacement, both ends of the resistor R3 are short-circuited (in FIG. 27, the resistor R3 whose both ends are short-circuited is not shown). A source of the correcting transistor M2 of the power supply circuit 52*a* is connected to the input terminal 10, its drain is connected to the non-inverting input terminal (+) of the differential amplifier 4, and its gate is supplied with a constant voltage from the constant voltage source 22.

The power supply circuit 52*a* has the same circuit configuration as that of the power supply circuit 52 of FIG. 26 unless otherwise specified. In FIG. 27, the same components as those of FIGS. 1, 17, 26, etc. are indicated by the same reference numerals, to omit duplicated description of the same components in principle.

For example, if the mutual conductance gm1 of the output transistor M1 has become relatively large due to variation of the manufacturing processes etc. in the power supply circuit 52*a*, a gate-source voltage of the output transistor M1 with respect to the same output current Io becomes relatively small, to make the potential of the inverting input terminal (−) of the differential amplifier 4 relatively high, but simultaneously, a drain current (correcting current) of the correcting transistor M2 becomes relatively large to make the potential of the non-inverting input terminal (+) of the differential amplifier 4 relatively high. Therefore, the same effects as those of the other embodiments can be obtained in the power supply circuit 52*a* also.

Of course, in the power supply circuits 52 and 52*a* (FIGS. 26 and 27) also, as in the case of the other embodiments, a plurality of correcting transistors may be provided as the correcting transistor and the resistors R3 and R4 (only the resistor R4 in the power supply circuit 52*a* of FIG. 27) may be formed as a variable resistor.

Although in the power supply circuits 52 and 52*a*, the transistor M10 has been provided so that a drain current of the transistor M10 may flow toward the output current limiting circuit, such a current need not necessarily flow, so that the transistor M10 may be omitted in some modifications.

Modifications

In the first to sixth embodiments, the output transistor Q1, the correcting transistor Q2, etc. may be replaced with an NPN type bipolar transistor. In a case where the output transistor is formed as an NPN type bipolar transistor, for example, a collector of the output transistor is connected to the input terminal 10. In a case where the correcting transistor is formed as an NPN type bipolar transistor, for example, a collector of the correcting transistor is connected to the input terminal 10. In a case where the output transistor Q1 and the correcting transistor Q2 are each replaced with an NPN type bipolar transistor, a circuit configuration of the other components is also changed appropriately.

Similarly, in the seventh to thirteenth embodiments, the output transistor M1, the correcting transistor Q2, etc. may be replaced with an N-channel type MOSFET. In a case where the output transistor M1 and the correcting transistor M2 are each replaced with an N-channel type MOSFET, a circuit configuration of the other components is also changed appropriately.

Further, in a power supply circuit of the embodiments, a bipolar transistor and a field effect transistor such as an MOSFET may be mixed. In a case where a bipolar transistor and an MOSFET are mixed, the power supply circuits can be formed also through the BiCMOS processes.

A stabilized DC power supply circuit (stabilized DC power supply unit) according to the present invention may be well applied to an electronic apparatus such as a cell phone, a personal digital assistant (PDA), or a recording medium driving device for recording information to and reproducing it from a recording medium represented by a compact disk read only memory (CD-ROM), a digital versatile disk read only memory (DVD-ROM), and a digital versatile disk random access memory (DVD-RAM).

Figure 28:
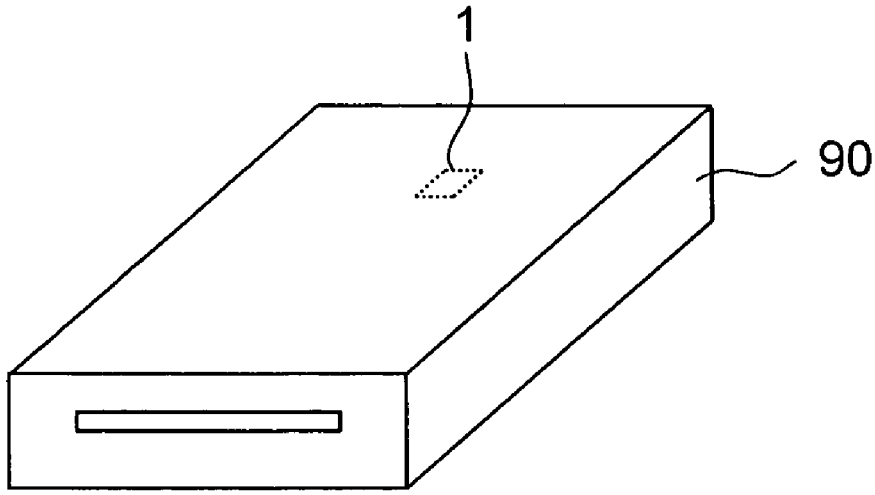
FIG. 28 is an external view of a recording medium driving device equipped with the stabilized DC power supply circuit of FIG. 1 etc.

FIG. 28 is an external view of a recording medium driving device 90, as an electronic apparatus, equipped with the power supply circuit 1 (FIG. 1) as one example of a stabilized DC power supply circuit according to the present invention. Loads such as a processing unit, not shown, incorporated in the recording medium driving device 90 operate by using the output voltage Vo of the power supply circuit 1 as a driving source. Of course, the power supply circuit 1 in the recording medium driving device 90 can be replaced with the power supply circuit (power supply circuit 1*a* etc.) of any one of the second to thirteenth embodiments.

Further, a stabilized DC power supply circuit according to the present invention or this circuit excluding the output transistor is utilized, for example, as a stabilized DC power supply integrated circuit (IC).

What is claimed is:

1. A stabilized DC power supply circuit equipped with an output transistor between an input terminal and an output terminal, comprising:

an output current limiting circuit for limiting an output current of the output transistor; and a correction circuit for correcting variation in restriction of the output current caused by variation in relationship between a physical quantity at a control electrode of the output transistor and the output current of the output transistor, wherein the output transistor is a field effect transistor, the relationship between the physical quantity at the control electrode and the output current is mutual conductance, and the output current limiting circuit limits the output current of the output transistor based on a reflection potential that reflects the output current of the output transistor and a mutual conductance of the output transistor.

2. A stabilized DC power supply circuit equipped with an output transistor between an input terminal and an output terminal, comprising:

an output current limiting circuit for limiting an output current of the output transistor; and a correction circuit for correcting variation in restriction of the output current caused by variation in relationship between a physical quantity at a control electrode of the output transistor and the output current of the output transistor, wherein the correction circuit includes a correcting transistor that is manufactured through the same manufacturing process as that for the output transistor and formed so as to have the same tendency of variation of the manufacturing process of the relationship as that of the output transistor and uses the correcting transistor to thereby correct variation in restriction of the output current of the output transistor caused by variation of the relationship.

3. The stabilized DC power supply circuit according to claim 2, wherein the correcting transistor has also the same temperature-dependency of the relationship as that of the output transistor.

4. The stabilized DC power supply circuit according to claim 2, wherein the output transistor is a field effect transistor, the relationship between the physical quantity at the control electrode and the output current is mutual conductance, and the output current limiting circuit limits the output current of the output transistor based on a reflection potential that reflects the output current of the output transistor and a mutual conductance of the output transistor and based on a physical quantity that reflects a mutual conductance of the correcting transistor.

5. The stabilized DC power supply circuit according to claim 2, wherein the correcting transistor is constituted of a plurality of correcting transistors.

6. The stabilized DC power supply circuit according to claim 2, wherein one of two conducting electrodes of the output transistor and one of two conducting electrodes of the correcting transistor are commonly connected to the input terminal that is supplied with an input voltage from an outside.

7. The stabilized DC power supply circuit according to claim 2, wherein the output transistor and the correcting transistor are each a bipolar transistor, the relationship between the physical quantity at the control electrode and the output current is current amplification factor, and the output current limiting circuit limits the output current of the output transistor based on a detecting current which is a base current of the output transistor and a correcting current obtained from the correcting transistor.

8. The stabilized DC power supply circuit according to claim 7, wherein the correction circuit supplies a constant current to a base of the correcting transistor, to output an output current of the correcting transistor as the correcting current.

9. The stabilized DC power supply circuit according to claim 8, wherein the output current limiting circuit includes a differential amplifier that receives at its first input terminal a detection potential that corresponds to the detecting current and compares the detection potential with a reference potential supplied at its second input terminal, if the detection potential is larger than the reference potential, the differential amplifier limits the detecting current to thereby limit the output current of the output transistor, and the correcting current flows so as to raise the detection potential.

10. The stabilized DC power supply circuit according to claim 7, wherein the correction circuit supplies a constant current as an output current of the correcting transistor, to output a base current of the correcting transistor as the correcting current.

11. The stabilized DC power supply circuit according to claim 10, wherein the output current limiting circuit includes a differential amplifier that receives at its first input terminal a detection potential that corresponds to the detecting current and compares the detection potential with a reference potential supplied at its second input terminal, if the detection potential is larger than the reference potential, the differential amplifier limits the detecting current to thereby limit the output current of the output transistor, and the correcting current flows so as to raise the reference potential.

12. The stabilized DC power supply circuit according to claim 7, wherein the correction circuit includes a correcting current mirror circuit for proportionally multiplying the detecting current and providing it as the base current of the correcting transistor, to thereby output an output current of the correcting transistor as the correcting current.

13. The stabilized DC power supply circuit according to claim 12, wherein the output current limiting circuit includes a detecting current mirror circuit for proportionally multiplying the detecting current and outputting it and uses an output current of the detecting current mirror circuit, to thereby limit the output current of the output transistor, and not only detecting current but also the correcting current flow through a first resistor that is provided on an input side of the detecting current mirror circuit and that forms the detecting current mirror circuit.

14. The stabilized DC power supply circuit according to claim 12, wherein the correcting transistor is constituted of a plurality of correcting transistors, the correcting current mirror circuit is constituted of a plurality of transistors, and each of the correcting transistors is allocated each of the transistors that constitute the correcting current mirror circuit.

15. The stabilized DC power supply circuit according to claim 7, wherein the correction circuit includes a correcting current mirror circuit for proportionally multiplying the detecting current and providing it as an output current of the correcting transistor, to thereby output the base current of the correcting transistor as the correcting current.

16. The stabilized DC power supply circuit according to claim 15, wherein the output current limiting circuit includes a detecting current mirror circuit for proportionally multiplying the detecting current and outputting it and uses an output current of the detecting current mirror circuit, to thereby limit the output current of the output transistor, and not only detecting current but also the correcting current flow through a first resistor that is provided on an input side of the detecting current mirror circuit and that forms the detecting current mirror circuit.

17. The stabilized DC power supply circuit according to claim 15, wherein the correcting transistor is constituted of a plurality of correcting transistors, the correcting current mirror circuit is constituted of a plurality of transistors, and each of the correcting transistors is allocated each of the transistors that constitute the correcting current mirror circuit.

18. The stabilized DC power supply circuit according to claim 2, wherein the output transistor and the correcting transistor are each a field effect transistor, the relationship between the physical quantity at the control electrode and the output current is mutual conductance, and the output current limiting circuit limits the output current of the output transistor based on a detecting current that reflects the output current of the output transistor and a mutual conductance of the output transistor and based on a correcting current obtained from the correcting transistor.

19. The stabilized DC power supply circuit according to claim 18, wherein the correction circuit supplies a constant voltage as a gate voltage of the correcting transistor, to output an output current of the correcting transistor as the correcting current.

20. The stabilized DC power supply circuit according to claim 19, wherein the output current limiting circuit includes a differential amplifier that receives at its first input terminal a detection potential that corresponds to the detecting current and compares the detection potential with a reference potential supplied at its second input terminal, if the detection potential is larger than the reference potential, the differential amplifier limits the detecting current to thereby limit the output current of the output transistor, and the correcting current flows so as to raise the detection potential.

21. The stabilized DC power supply circuit according to claim 19, wherein the output current limiting circuit includes a detecting current mirror circuit for proportionally multiplying the detecting current and outputting it and uses an output current of the detecting current mirror circuit, to thereby limit the output current of the output transistor, and not only detecting current but also the correcting current flow through a first resistor that is provided on an input side of the detecting current mirror circuit and that forms the detecting current mirror circuit.

22. The stabilized DC power supply circuit according to claim 18, wherein the correction circuit supplies a constant current as an output current of the correcting transistor, to output a current that flows corresponding to a gate voltage of the correcting transistor, as the correcting current.

23. The stabilized DC power supply circuit according to claim 22, wherein the output current limiting circuit includes a differential amplifier that receives at its first input terminal a detection potential that corresponds to the detecting current and compares the detection potential with a reference potential supplied at its second input terminal, if the detection potential is larger than the reference potential, the differential amplifier limits the detecting current to thereby limit the output current of the output transistor, and the correcting current flows so as to raise the reference potential.

24. The stabilized DC power supply circuit according to claim 18, wherein the correction circuit includes a correcting current mirror circuit for proportionally multiplying the detecting current and outputting it, to apply a voltage that corresponds to an output current of the correcting current mirror circuit to a gate of the correcting transistor, thereby outputting an output current of the correcting transistor as the correcting current.

25. The stabilized DC power supply circuit according to claim 24, wherein the output current limiting circuit includes a detecting current mirror circuit for proportionally multiplying the detecting current and outputting it and uses an output current of the detecting current mirror circuit, to thereby limit the output current of the output transistor, and not only detecting current but also the correcting current flow through a first resistor that is provided on an input side of the detecting current mirror circuit and that forms the detecting current mirror circuit.

26. The stabilized DC power supply circuit according to claim 24, wherein the correcting transistor is constituted of a plurality of correcting transistors, the correcting current mirror circuit is constituted of a plurality of transistors, and each of the correcting transistors is allocated each of the transistors that constitute the correcting current mirror circuit.

27. A stabilized DC power supply circuit equipped with an output transistor between an input terminal and an output terminal, comprising:

an output current limiting circuit for limiting an output current of the output transistor; and a correction circuit for correcting variation in restriction of the output current caused by variation in relationship between a physical quantity at a control electrode of the output transistor and the output current of the output transistor, wherein the output transistor is a bipolar transistor, the relationship between the physical quantity at the control electrode and the output current is current amplification factor, and the correction circuit includes a correcting transistor that is manufactured through the same manufacturing process as that for the output transistor and formed so that a current amplification factor of its own may also increase as a current amplification factor of the output transistor increases due to variation of the manufacturing process and uses the correcting transistor to thereby correct variation in restriction of the output current of the output transistor caused by variation in the current amplification factor of the output transistor.

28. A stabilized DC power supply circuit equipped with an output transistor between an input terminal and an output terminal, comprising:

an output current limiting circuit for limiting an output current of the output transistor; and a correction circuit for correcting variation in restriction of the output current caused by variation in relationship between a physical quantity at a control electrode of the output transistor and the output current of the output transistor, wherein the output transistor is a field effect transistor, the relationship between the physical quantity at the control electrode and the output current is mutual conductance, and the correction circuit includes a correcting transistor that is manufactured through the same manufacturing process as that for the output transistor and formed so that a mutual conductance of its own may also increase as a mutual conductance of the output transistor increases due to variation of the manufacturing process and uses the correcting transistor to thereby correct variation in restriction of the output current of the output transistor caused by variation in the mutual conductance of the output transistor.

29. A stabilized DC power supply circuit equipped with an output transistor between an input terminal and an output terminal, comprising:

an output current limiting circuit for limiting an output current of the output transistor; and a correction circuit for correcting variation in restriction of the output current caused by variation in relationship between a physical quantity at a control electrode of the output transistor and the output current of the output transistor, wherein the output transistor is a bipolar transistor, the relationship between the physical quantity at the control electrode and the output current is current amplification factor, and the output current limiting circuit limits the output current of the output transistor based on a detecting current which is a base current of the output transistor.

30. The stabilized DC power supply circuit according to claim 29, wherein the output current limiting circuit includes a differential amplifier that receives at its first input terminal a detection potential that corresponds to the detecting current and compares the detection potential with a reference potential supplied at its second input terminal and uses an output of the differential amplifier to thereby limit the output current of the output transistor.

31. The stabilized DC power supply circuit according to claim 30, wherein if the detection potential is larger than the reference potential, the differential amplifier limits the detecting current to thereby limit the output current of the output transistor.

32. The stabilized DC power supply circuit according to claim 30, wherein the detection potential is determined by a current flowing through a first resistor connected to the first input terminal, and the reference potential is determined by a current flowing through a second resistor connected to the second input terminal.

33. The stabilized DC power supply circuit according to claim 32, wherein the first and second resistors are resistors of the same type that have been manufactured through the same manufacturing process.

34. The stabilized DC power supply circuit according to claim 32, wherein the first and second resistors are a variable resistor.

35. The stabilized DC power supply circuit according to claim 29, wherein the output current limiting circuit includes a detecting current mirror circuit for proportionally multiplying the detecting current and outputting it and uses an output current of the detecting current mirror circuit, to thereby limit the output current of the output transistor.

36. A stabilized DC power supply circuit equipped with an output transistor between an input terminal and an output terminal, comprising:

an output current limiting circuit for limiting an output current of the output transistor; and a correction circuit for correcting variation in restriction of the output current caused by variation in relationship between a physical quantity at a control electrode of the output transistor and the output current of the output transistor, wherein the output transistor is a field effect transistor, the relationship between the physical quantity at the control electrode and the output current is mutual conductance, and the output current limiting circuit limits the output current of the output transistor based on a detecting current that reflects the output current of the output transistor and a mutual conductance of the output transistor.

37. The stabilized DC power supply circuit according to claim 36, wherein the output current limiting circuit includes a differential amplifier that receives at its first input terminal a detection potential that corresponds to the detecting current and compares the detection potential with a reference potential supplied at its second input terminal and uses an output of the differential amplifier to thereby limit the output current of the output transistor.

38. The stabilized DC power supply circuit according to claim 37, wherein if the detection potential is larger than the reference potential, the differential amplifier limits the detecting current to thereby limit the output current of the output transistor.

39. The stabilized DC power supply circuit according to claim 37, wherein the detection potential is determined by a current flowing through a first resistor connected to the first input terminal, and the reference potential is determined by a current flowing through a second resistor connected to the second input terminal.

40. The stabilized DC power supply circuit according to claim 39, wherein the first and second resistors are resistors of the same type that have been manufactured through the same manufacturing process.

41. The stabilized DC power supply circuit according to claim 39, wherein the first and second resistors are a variable resistor.

42. The stabilized DC power supply circuit according to claim 36, wherein the output current limiting circuit includes a detecting current mirror circuit for proportionally multiplying the detecting current and outputting it and uses an output current of the detecting current mirror circuit, to thereby limit the output current of the output transistor.

* * * * *